US007326097B2

(12) United States Patent
Nomura et al.

(10) Patent No.: US 7,326,097 B2
(45) Date of Patent: Feb. 5, 2008

(54) METHOD AND APPARATUS FOR MANUFACTURING IMAGE DISPLAYING APPARATUS

(75) Inventors: Ichiro Nomura, Kanagawa-ken (JP); Kohei Nakata, Tokyo (JP); Tetsuya Kaneko, Kanagawa-ken (JP); Toshihiko Miyazaki, Kanagawa-ken (JP); Yasue Sato, Tokyo (JP); Toshikazu Ohnishi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 170 days.

(21) Appl. No.: 10/913,542

(22) Filed: Aug. 9, 2004

(65) Prior Publication Data

US 2005/0009433 A1 Jan. 13, 2005

Related U.S. Application Data

(62) Division of application No. 09/809,055, filed on Mar. 16, 2001, now Pat. No. 6,848,961.

(30) Foreign Application Priority Data

Mar. 16, 2000 (JP) ..... 2000-073646

(51) Int. Cl.
*H01J 9/00* (2006.01)
*H01J 9/24* (2006.01)

(52) U.S. Cl. ..... 445/24; 445/25; 445/6

(58) Field of Classification Search ..... 445/24, 445/9, 21, 38, 40, 41, 55, 66, 70, 73
See application file for complete search history.

(56) References Cited

U.S. PATENT DOCUMENTS

| | | | | |
|---|---|---|---|---|
| 4,904,895 | A | 2/1990 | Tsukamoto et al. | 313/336 |
| 5,066,883 | A | 11/1991 | Yoshioka et al. | 313/309 |
| 5,433,639 | A * | 7/1995 | Zahuta et al. | 445/40 |
| 5,564,958 | A * | 10/1996 | Itoh et al. | 445/6 |
| 5,605,483 | A | 2/1997 | Takeda et al. | 445/2 |
| 5,622,634 | A * | 4/1997 | Noma et al. | 216/40 |
| 5,749,763 | A | 5/1998 | Yoshioka et al. | 445/51 |
| 5,789,859 | A | 8/1998 | Watkins et al. | 313/495 |
| 5,813,893 | A | 9/1998 | Robinson | 445/25 |
| 5,846,110 | A | 12/1998 | Kanagu et al. | 445/25 |
| 5,938,494 | A | 8/1999 | Betsui et al. | 445/24 |
| 6,017,259 | A * | 1/2000 | Motoi et al. | 445/51 |
| 6,034,478 | A | 3/2000 | Kawade et al. | 315/169.1 |

(Continued)

FOREIGN PATENT DOCUMENTS

JP 7-235255 9/1995

(Continued)

*Primary Examiner*—Sikha Roy
*Assistant Examiner*—Natalie K. Walford
(74) *Attorney, Agent, or Firm*—Fitzpatrick, Cella, Harper & Scinto

(57) ABSTRACT

A method and an apparatus of manufacturing an image displaying apparatus including an electron source substrate and a phosphor substrate. The electron source substrate is provided with an electron emitting element formed by covering with a container and by applying a voltage to an electronic conductor on the substrate. While, the phosphor substrate is provided with a phosphor thereon. The substrates are subjected to a getter processing and to a seal bonding process under a vacuum condition through a processing chamber, to complete an image forming apparatus. An improvement resides in miniaturizing and simplifying operation, and in greater manufacture speed and mass production.

7 Claims, 21 Drawing Sheets

U.S. PATENT DOCUMENTS

| | | | | |
|---|---|---|---|---|
| 6,049,167 | A | 4/2000 | Onitsuka et al. | 313/512 |
| 6,063,453 | A | 5/2000 | Tomida et al. | 427/532 |
| 6,132,280 | A | 10/2000 | Tanabe et al. | 445/58 |
| 6,169,356 | B1 | 1/2001 | Ohnishi et al. | 313/495 |
| 6,213,834 | B1 | 4/2001 | Ohnishi et al. | 445/6 |
| 6,246,168 | B1 | 6/2001 | Kishi et al. | 313/495 |
| 6,348,761 | B1 | 2/2002 | Nomura et al. | 313/495 |
| 6,419,540 | B1 | 7/2002 | Tanaka et al. | 445/24 |
| 6,473,063 | B1 | 10/2002 | Suzuki et al. | 345/74.1 |
| 6,593,950 | B2 | 7/2003 | Nomura et al. | 347/122 |
| 6,626,718 | B2 | 9/2003 | Hiroki | 445/6 |
| 6,634,916 | B2 | 10/2003 | Kaneko et al. | 445/25 |
| 6,726,520 | B2 | 4/2004 | Takeda et al. | 445/62 |
| 6,752,676 | B2 | 6/2004 | Yamashita et al. | 445/6 |
| 6,821,174 | B2 * | 11/2004 | Kaneko et al. | 445/6 |
| 6,846,213 | B2 * | 1/2005 | Sato | 445/6 |
| 6,905,384 | B2 * | 6/2005 | Miyazaki et al. | 445/25 |
| 2001/0034175 | A1 | 10/2001 | Miyazaki et al. | 445/25 |
| 2001/0039161 | A1 | 11/2001 | Sato | 445/25 |
| 2002/0009944 | A1 | 1/2002 | Ouchi | 445/24 |
| 2004/0154545 | A1 | 8/2004 | Takeda et al. | 118/728 |

FOREIGN PATENT DOCUMENTS

| | | |
|---|---|---|
| JP | 8-171849 | 7/1996 |
| JP | 09-256153 | 9/1997 |
| JP | 11-135018 | 5/1999 |

* cited by examiner

METHOD AND APPARATUS FOR MANUFACTURING IMAGE DISPLAYING APPARATUS

This application is a division of U.S. application Ser. No. 09/809,055, filed Mar. 16, 2001 now U.S. Pat. No. 6,848,961.

BACKGROUND OF THE INVENTION

1. Field of the Invention

The present invention relates to a method of manufacturing an image displaying apparatus in which a plurality of electron sources are arranged, and to an apparatus for manufacturing the same.

2. Related Background Art

Conventionally, an electron-emitting device is roughly divided into two known types, i.e., a thermal electron-emitting device and a cold-cathode electron-emitting device. The cold-cathode electron-emitting device includes a field emission type, a metal/insulating layer/metal type, a surface conduction electron-emitting device, and the like.

A surface conduction electron-emitting device is to utilize such a phenomenon that electron emission generates by flowing electric current to a thin film with a small area formed on a substrate, in parallel with the surface of the film. The applicant of the present invention made a large number of proposals on the surface conduction electron-emitting device having a novel structure and its application. The fundamental structure thereof, its manufacturing method, etc. are disclosed in Japanese Patent Application Laid-open Nos. 7-235255, 8-171849, etc., for instance.

The surface conduction electron-emitting device is characterized in that the device has a structure in which a pair of device electrodes facing with each other and a conductive film which is connected to the pair of device electrodes and has an electron-emitting region (fissure) at a part thereof are formed on the substrate. Further, at the end of the fissure, a deposition film is formed which contains as a main component at least one of carbon and a carbon compound.

A plurality of such electron-emitting devices are arranged on a substrate, and the respective electron-emitting devices are connected through wirings, with the result that an electron source having a plurality of the surface conduction electron-emitting devices can be formed. In addition, a display panel of an image displaying apparatus can be formed by combining the electron source and a phosphor.

Conventionally, the manufacture of such electron sources and the display panels are carried out as follows.

As a method of manufacturing an electron source, first, an electron source substrate is formed in which a conductive film, a plurality of devices consisting of a pair of device electrodes connected to the conductive film, and wirings connecting the plurality of devices are formed on a substrate. Then, the manufactured electron source substrate as a whole is disposed in a vacuum chamber, and the exhaustion within the vacuum chamber is performed. Thereafter, a voltage is applied to the respective devices through an external terminal, to thereby cause fissures in the conductive films of the respective devices. In addition, a gas containing an organic substance is introduced into the vacuum chamber, and then a voltage is applied to the respective devices again through the external terminal under the organic substance existing atmosphere, to thereby cause a deposition of carbon or a carbon compound in the vicinity of the fissures.

Further, as a second manufacturing method, first, an electron source substrate is formed in which a conductive film, a plurality of devices consisting of a pair of device electrodes connected to the conductive film, and wirings connecting the plurality of devices are formed on a substrate. The electron source substrate thus manufactured and a phosphor substrate on which phosphors are arranged are joined next while sandwiching a support frame to form a panel of an image displaying apparatus. Thereafter, an exhaustion within the panel is carried out through an exhaust pipe of the panel, and fissures are formed in the conductive films of the respective devices by applying a voltage to the respective devices through an external terminal. In addition, a gas containing an organic substance is introduced into the panel through the exhaust pipe, and a voltage is applied again to the respective devices under the organic substance existing atmosphere, to thereby cause a deposition of carbon or a carbon compound in the vicinity of the fissures.

For manufacturing a vacuum container for a display panel, in which an electron source substrate on which such electron-emitting devices are arranged in matrix and a phosphor substrate provided with phosphors are defined as insides in the respective surfaces, and the inside thereof is made into a high vacuum state, the following process is carried out in which the electron source substrate (hereinafter, also referred to as "RP") and the phosphor substrate (hereinafter, also referred to "FP") are disposed oppositely, the inside thereof is sealed using a low-melting point material such as a frit glass and indium as a sealing material, and a vacuum exhaust pipe provided in advance is sealed off after vacuum exhausting the inside from the vacuum exhaust pipe, to thereby form the display panel.

The manufacturing method according to the conventional art described above requires considerably long time for manufacturing one display panel, thus is not suitable for manufacturing a display panel inside of which requires the vacuum degree of 10−6 Pa or more.

The drawbacks of this conventional art were solved by a method described, for example, in Japanese Patent Application Laid-open No. 11-135018.

The above-mentioned methods are used to manufacture the image displaying apparatus, in the first manufacturing method, particularly, as the electron source substrate becomes larger in sizes, the larger-scale vacuum chamber and the exhausting apparatus that can deal with high vacuum are become necessary. Also, the second manufacturing method includes a problem in that it takes a long period of time for exhausting a gas from the space within the panels of the image displaying apparatus, and for introducing a gas containing an organic substance into the space with the panel.

Besides, in the method described in Japanese Patent Application Laid-open No. 11-135018, only a step of sealing two substrates after an alignment (registration) of an FP and an RP is performed in a single vacuum chamber, is used. Therefore, the other processes such as a baking process, a gettering process, and an electron beam cleaning process, which are necessary for the production of the display panel also need to be applied in the single vacuum chamber, respectively. In addition, since movement between each vacuum chamber of the FP and the RP is performed with breaking the atmosphere, each vacuum chamber is vacuum exhausted every time an FP and an RP are carried in. As a result, the manufacturing process time becomes longer. Therefore, considerable reduction of the manufacturing process time has been required, and at the same time, it has been required to attain in a short time a high vacuum degree of $10^{-6}$ Pa or more in a display panel during a final manufacturing process.

SUMMARY OF THE INVENTION

The present invention has an object to manufacture an electron source having an excellent electron-emitting characteristic, and to easily attain a reduction of vacuum exhaust time and a high vacuum degree, thereby improving a manufacturing efficiency.

Further, the present invention has another object to provide a method and a manufacturing apparatus of an electron source substrate and an image displaying apparatus which can easily be reduced in size and simplified in its operation.

The present invention is a method of manufacturing an image displaying apparatus, characterized by comprising the steps of:

a: disposing a substrate, on which an electrical conductor and a wiring connected to the conductor, on a support; covering the conductor with a container except for a part of the wiring; setting the container into a desired atmosphere; and applying a voltage to the conductor through the part of wiring (not covered), whereby forming an electron-emitting device at a part of the conductor to thereby form an electron source substrate;

b: preparing a phosphor substrate on which phosphor emitting light by the electron-emitting device is arranged, and arranging the electron source substrate and the phosphor substrate under a vacuum atmosphere;

c: carrying one or both of the electron source substrate and the phosphor substrate in a gettering process chamber in the vacuum atmosphere under the vacuum atmosphere, and a gettering process is performed to the one or both of the substrates carried therein; and d: carrying the electron source substrate and the phosphor substrate in a sealing process chamber in the vacuum atmosphere under the vacuum atmosphere, and heat seal-bonding the substrates in an opposing state.

Further, the present invention is an apparatus for manufacturing an image displaying apparatus, comprising:

a: an electron source substrate manufacturing apparatus including: a support for supporting a substrate on which a conductive member is formed; a gas introducing port; and a gas exhausting port; a container covering a region of a part of the substrate surface; means for introducing a gas into the container connected to the gas introducing port; and means for exhausting the inside of the container connected to the gas exhausting port, in which a voltage is applied to the conductor, and an electron-emitting device is formed at a part of the conductive member, whereby manufacturing the electron source;

b: means for conveying the electron source substrate obtained through the electron source substrate and a phosphor substrate provided with phosphor thereon;

c: a first vacuum chamber into which one or both of the electron source substrate and the phosphor substrate can be carried under the vacuum atmosphere by the conveying means;

d: means for providing getter having a getter precursor disposed in the first vacuum chamber and a getter activating means for activating the getter precursor;

e: a second vacuum chamber in which the electron source substrate and the phosphor substrate can be carried in under the vacuum atmosphere by the conveying means;

f: substrate arranging means, disposed in the second vacuum chamber, for arranging the electron source substrate and the phosphor substrate in opposing positions with each other by orienting the electron-emitting device and the phosphor toward inside; and g: seal-bonding means, arranged in the second vacuum chamber, for heat seal-bonding the electron source substrate and the phosphor substrate arranged in opposing positions by the substrate arranging means at a predetermined temperature.

DETAILED DESCRIPTION OF THE PREFERRED EMBODIMENTS

Figure 1:
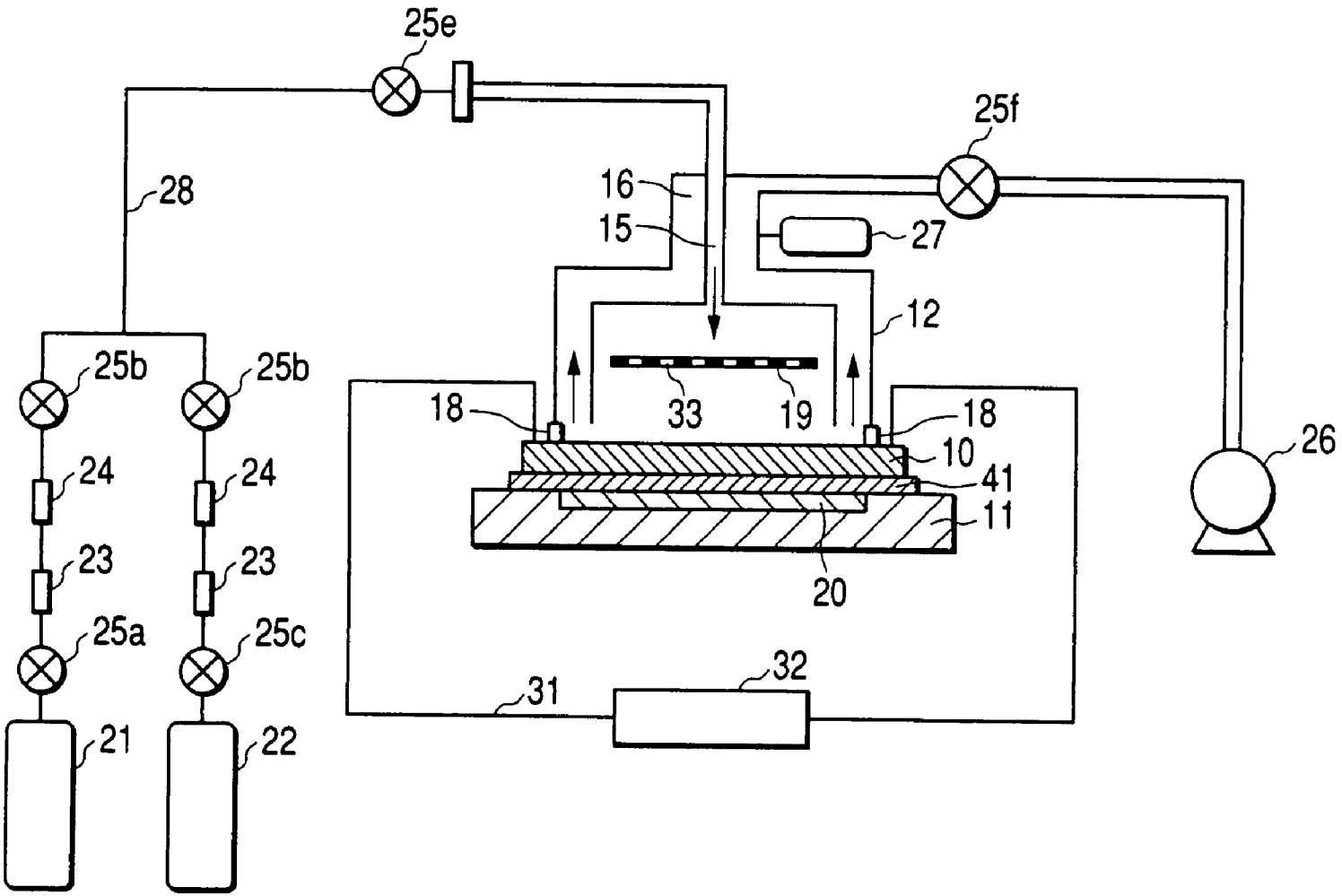
FIG. 1 is a cross-sectional view showing the structure of an apparatus for manufacturing an electron source according to the present invention.

Firstly, according to the present invention, a first feature thereof relates to a method of manufacturing an image displaying apparatus, comprising the steps of:

a: disposing a substrate, on which a conductive member and a wiring connected to the conductive member, on a supporting member; covering the conductive member with a container excepting a part of the wiring; setting the container into a desired atmosphere therein; and applying a voltage to the conductive member through the part of wiring (not covered), whereby forming an electron-emitting device at a part of the conductive member to thereby form an electron source substrate;

b: preparing a phosphor substrate on which phosphors are arranged which emit light by the electron-emitting device, and arranging the electron source substrate and the phosphor substrate are disposed under a vacuum atmosphere;

c: carrying one or both of the electron source substrate and the phosphor substrate in a gettering process chamber in the vacuum atmosphere under the vacuum atmosphere, and a gettering process is performed to the one or both of the substrates carried therein; and d: carrying the electron source substrate and the phosphor substrate in a seal-bonding process chamber in the vacuum atmosphere under the vacuum atmosphere, and heat sealing the substrates in an opposing state.

Secondary, according to the present invention, a second feature thereof relates to an apparatus for manufacturing an image displaying apparatus, comprising:

a: an electron source substrate manufacturing apparatus including: a supporting member for supporting a substrate on which a conductive member is formed; a gas introducing port; and a gas exhausting port; a container covering a region of a part of the substrate surface; means for introducing a gas into the container connected to the gas introducing port; and means for exhausting the inside of the container connected to the gas exhausting port, in which a voltage is applied to the conductive member, and an electron-emitting device is formed at a part of the conductive member, whereby manufacturing the electron source;

b: means for conveying the electron source substrate obtained through the electron source substrate and a phosphor substrate provided with phosphors thereon;

c: a first vacuum chamber into which one or both of the electron source substrate and the phosphor substrate can be carried under the vacuum atmosphere by the conveying means;

d: means for giving getter having a getter precursor disposed in the first vacuum chamber and a getter activating means for activating the getter precursor;

e: a second vacuum chamber in which the electron source substrate and the phosphor substrate can be carried in under the vacuum atmosphere by the conveying means;

f: substrate arranging means, disposed in the second vacuum chamber, for arranging the electron source substrate and the phosphor substrate in opposing positions with each other by orienting the electron-emitting device and the phosphor toward inside; and g: seal-bonding means, arranged in the second vacuum chamber, for heat seal-bonding the electron source substrate and the phosphor substrate arranged in opposing positions by the substrate arranging means at a predetermined temperature.

In the first feature of the present invention, the step of setting the container into a desired atmosphere therein preferably includes a step of exhausting the inside of the container.

In the first feature of the present invention, the step of setting the container into a desired atmosphere therein preferably includes a step of introducing a gas into the container.

In the first feature of the present invention, it is preferable that the method further includes a process of fixing, onto the supporting member, the substrate used for the electron source substrate.

In the first feature of the present invention, it is preferable that the process of fixing, onto the supporting member, the substrate used for the electron source substrate includes a step of vacuum-adsorbing the substrate onto the supporting member.

In the first feature of the present invention, it is preferable that the process of fixing, onto the supporting member, the substrate used for the electron source substrate includes a step of electrostatically-adsorbing the substrate onto the supporting member.

In the first feature of the present invention, it is preferable that the step of disposing, on the supporting member, the substrate used for the electron source substrate is performed while sandwiching a heat conductive member between the substrate and the supporting member.

In the first feature of the present invention, the step of applying a voltage to the conductive member preferably includes a step of adjusting the temperature of the substrate.

In the first feature of the present invention, the step of applying a voltage to the conductive member preferably includes a step of heating the substrate used for the electron substrate.

In the first feature of the present invention, the step of applying a voltage to the conductive member preferably includes a step of cooling the substrate used for the electron substrate.

In the first feature of the present invention, the processes b, c, and d are preferably processes set within an in-line.

In the first feature of the present invention, it is preferable that the processes b, c, and d are processes set within an in-line, and a heat shielding material is disposed between the gettering process chamber and the seal-bonding process chamber.

In the first feature of the present invention, the heat shielding material is preferably formed of a reflective metal.

In the first feature of the present invention, it is preferable that the processes b, c, and d are processes set within an in-line, and a gate valve is disposed between the gettering process chamber and the seal-bonding process chamber.

In the first feature of the present invention, it is preferable that the processes b, c, and d are processes set on a star arrangement.

In the first feature of the present invention, it is preferable that the processes b, c, and d are processes set on a star arrangement, and the gettering process chamber and the seal-bonding process chamber are partitioned by an independent chamber.

In the first feature of the present invention, the phosphor exciting means preferably has means for emitting electron beam.

In the first feature of the present invention, the electron source substrate preferably has an outer frame fixedly disposed in advance to its periphery.

In the first feature of the present invention, the electron source substrate preferably has a spacer fixedly disposed in advance to an inside thereof.

In the first feature of the present invention, the electron source substrate preferably has the outer frame fixedly disposed in advance to its periphery, and the spacer fixedly disposed in advance to the inside thereof.

In the first feature of the present invention, the phosphor substrate preferably has an outer frame fixedly disposed in advance to its periphery.

In the first feature of the present invention, the phosphor substrate preferably has a spacer fixedly disposed in advance to an inside thereof.

In the first feature of the present invention, the phosphor substrate preferably has the outer frame fixedly disposed in advance to its periphery, and the spacer fixedly disposed in advance to the inside thereof.

In the first feature of the present invention, the getter used in the above process c is preferably an evaporable getter such as a barium getter.

In the first feature of the present invention, the seal-bonding material used in the above process d is a low melting point metal such as indium or an alloy thereof or a low melting point material such as frit glass.

In the first feature of the present invention, the method further includes a step of arranging the electron-emitting devices in matrix, and forming wirings so as to connect in matrix the electron-emitting devices arranged in matrix.

In the second feature of the present invention, the first vacuum chamber and the second vacuum chamber are preferably disposed within an in-line.

In the second feature of the present invention, it is preferable that the first vacuum chamber and the second vacuum chamber are disposed within an in-line, and the respective chambers are partitioned by a heat shielding material.

In the second feature of the present invention, it is preferable that the first vacuum chamber and the second vacuum chamber are disposed on one line, and the respective chambers are partitioned by a gate valve.

In the second feature of the present invention, it is preferable that the first vacuum chamber and the second vacuum chamber are provided on a star arrangement, and the respective chambers are partitioned by an independent chamber.

In the second feature of the present invention, the supporting member preferably has a fixing means for fixing the substrate onto the supporting member.

In the second feature of the present invention, the supporting member preferably has means for vacuum adsorbing the substrate and the supporting member.

In the second feature of the present invention, the supporting member preferably has means for electrostatically-adsorbing the substrate and the supporting member.

In the second feature of the present invention, the supporting member preferably has a heat conductive member.

In the second feature of the present invention, the supporting member preferably has a temperature adjusting means for the substrate.

In the second feature of the present invention, the supporting member preferably has heating means.

In the second feature of the present invention, the supporting member preferably has cooling means.

In the second feature of the present invention, the container preferably has, in the container, means for diffusing a gas introduced thereinto.

In the second feature of the present invention, it is preferable that the apparatus further includes means for heating a gas to be introduced.

In the second feature of the present invention, it is preferable that the apparatus further includes means for removing the moisture from the gas to be introduced.

In the second feature of the present invention, it is preferable that the electron-emitting device is arrange in matrix, and the wirings are arranged so as to connect in matrix the electron-emitting device arranged in matrix.

Hereinbelow, the present invention will be described in more detail.

A manufacturing apparatus according to the present invention, first, includes a supporting member for supporting a substrate having a conductive member previously formed thereon, and a container covering the substrate supported by the supporting member. In this case, the container is provided to cover a part of region of the substrate surface, and an air-tight space may be formed on the substrate under such a state that a part of wiring formed on the substrate and connected to the conductive member formed on the substrate is exposed outside the container. Further, in the container, a gas introducing port and a gas exhausting port are provided, and means for introducing a gas into the container, and means for exhausting the gas within the container are connected to the gas introducing port and the gas exhausting port, respectively. With this structure, the inside of the container can be set into a predetermined atmosphere. Also, the substrate having the conductive member previously formed thereon is an electron-emitting substrate in which the electron-emitting device portion is formed by subjecting an electrical process to the conductive member to constitute the electron source. Therefore, the manufacturing apparatus according to the present invention also includes means for subjecting the electrical process, for example, such as means for applying a voltage to the conductive member. In the manufacturing apparatus described above, miniaturization of the apparatus can be attained, and in addition to the attainment of a simple operation such as electrical connection to a power source during the electrical process described above, a freedom of design such as the size and the shape of the container is increased. As a result, the introduction of the gas into the container and the exhaustion of the gas to the outside of the container become possible to carry out within a short period of time.

Further, in the manufacturing method according to the present invention, first, a substrate having a conductive member and a wiring connected thereto previously formed thereon is disposed onto the supporting member, and the conductive member formed on the substrate is covered with a container excepting a part of the wiring. With this, the conductive member is disposed within an airtight space formed on the substrate under such a state that a part of wiring formed on the substrate is exposed to the outside of the container. Then, the inside of the container is set into a desired atmosphere, and the electrical process such as an application of a voltage to the conductive member is carried out through the part of wiring exposed to the outside of the container. Here, the desired atmosphere described above is, for example, a reduced-pressure atmosphere, or an atmosphere in which a special gas exists. Besides, the above-mentioned electrical process is a step of forming an electron-emitting portion on the conductive member to thereby constitute an electron source. Further, there is a case where the above-mentioned electrical process is performed plural times under different atmospheres. For example, the conductive member formed on the substrate is covered with the container excepting a part of the wiring, and firstly a step of conducting the electrical process under setting the container into a first atmosphere is performed, and then a step of conducting the electrical process under setting the container into a second atmosphere. As a result, an excellent electron-emitting portion is formed on the conductive member, to thereby form an electron source substrate. In this case, the first and second atmospheres are preferably the first atmosphere which has a reduced-pressure and the second atmosphere in which a specific gas such as a carbon compound exists, respectively. In the above-mentioned manufacturing method, it becomes possible for the electrical connection to a power source upon the electrical process to be made easily. In addition, a freedom of design such as the size or the shape of the container is increased, thereby being capable of introducing a gas into the container and of exhausting the gas outside the container within a short period of time. As a result, in addition to an enhancement of the manufacturing speed, reproducibility of electron-emitting characteristics of the manufactured electron source, particularly the uniformity of the electron-emitting characteristics of the electron source having a plurality of the electron-emitting portion is improved.

Note that, in the present invention, the conductive member formed on the substrate means the one that constitutes the electron-emitting device by a current supplying process.

EMBODIMENT MODE OF THE PRESENT INVENTION

A first preferred embodiment mode of the present invention will next be described.

Figure 2:
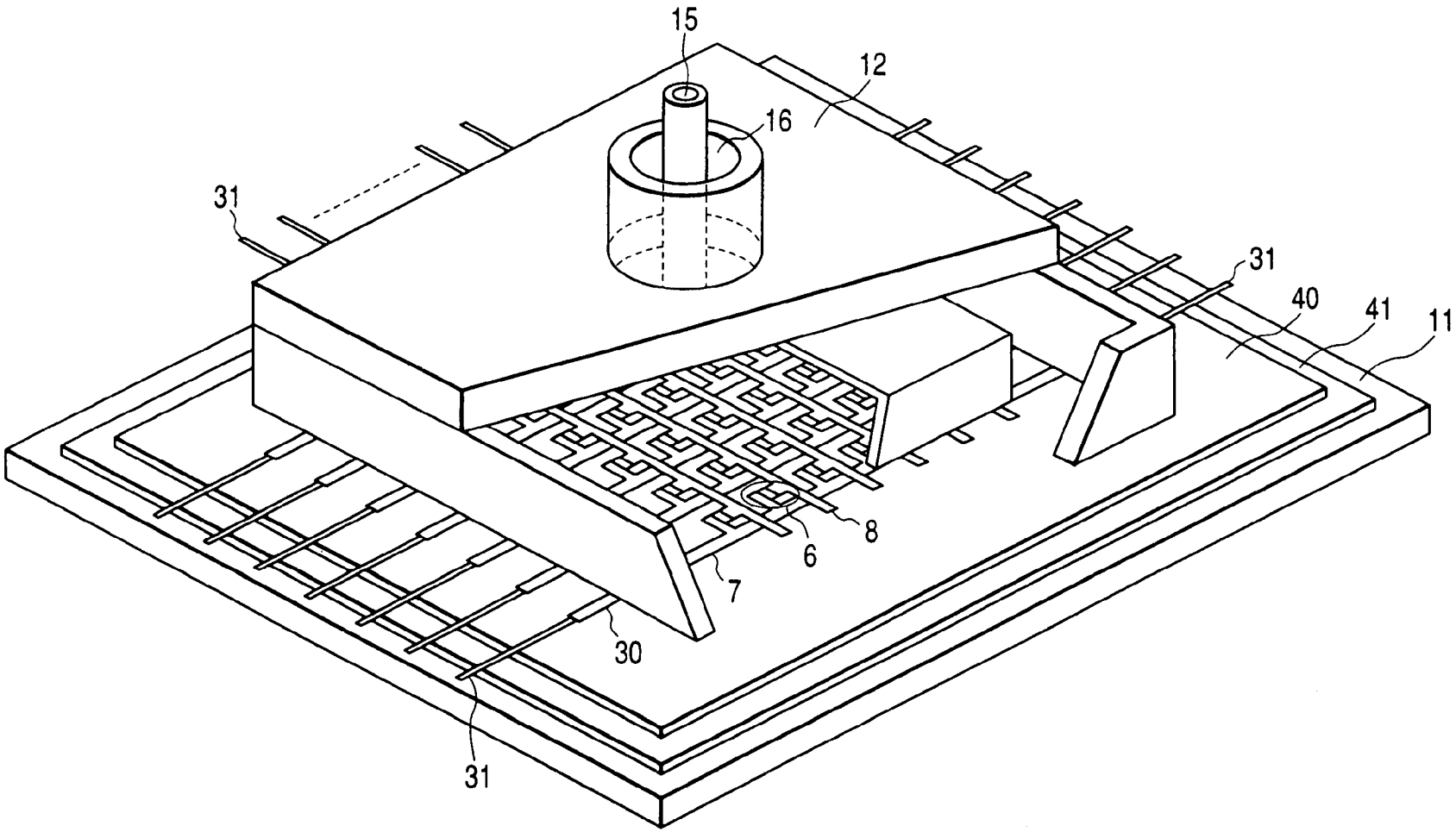
FIG. 2 is a perspective view in which a part of its periphery portion of an electron source substrate of FIGS. 1 and 3 is broken.
Figure 3:
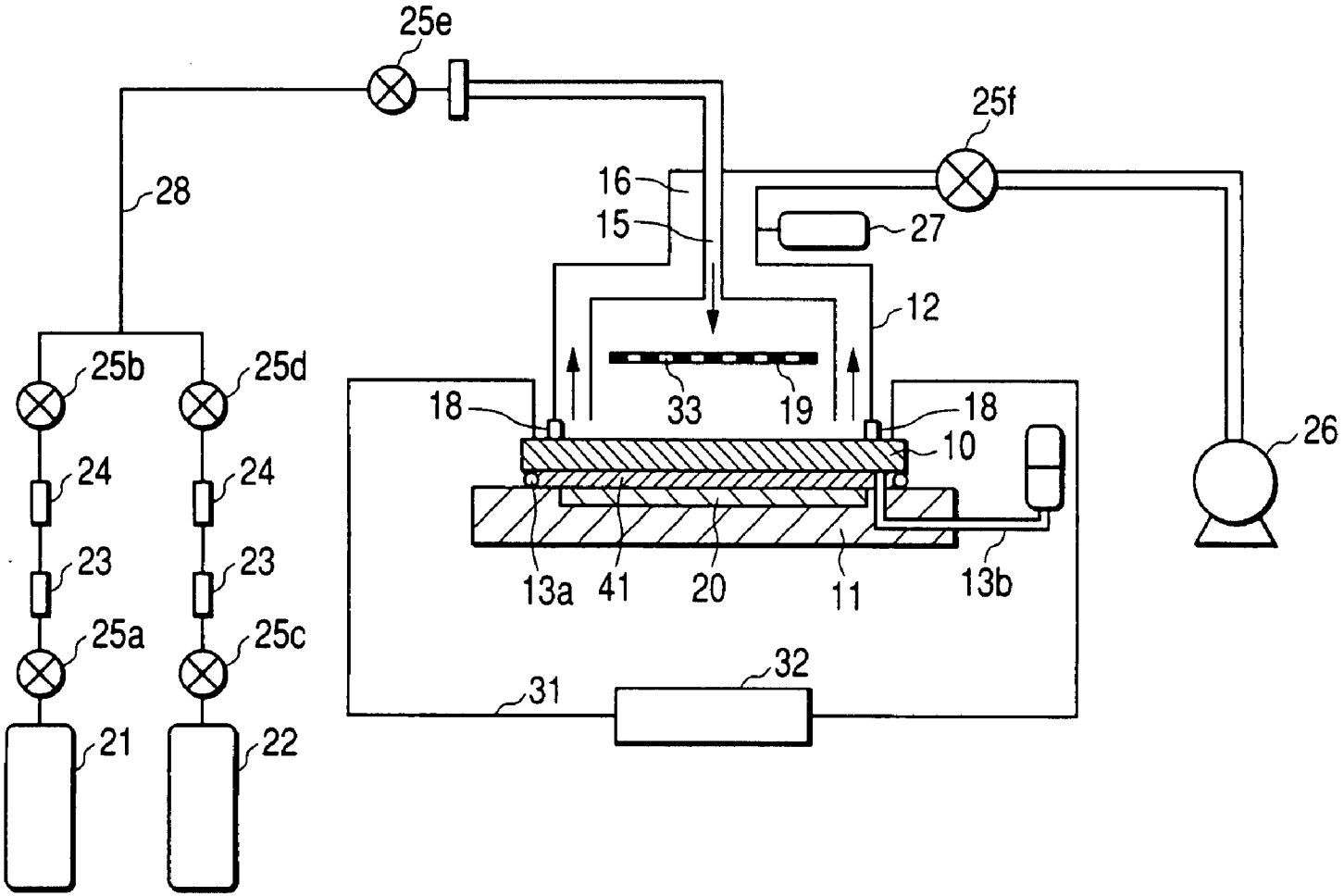
FIG. 3 is a cross-sectional view showing another mode of the structure of the apparatus for manufacturing the electron source according to the present invention.

FIGS. 1, 2 and 3 show a manufacturing apparatus of the electron source substrate according to this embodiment mode. FIGS. 1 and 3 are cross-sectional views, and FIG. 2 is a perspective view showing the peripheral portion of the electron source substrate of FIG. 1. In FIGS. 1, 2 and 3, reference numeral 6 denotes a conductive member that becomes an electron-emitting device; 7, an X directional wiring; 8, a Y directional wiring; 10, an electron source substrate; 11, a supporting member; 12, a vacuum container; 15, a gas introducing path; 16, a gas exhausting path; 18, a seal-bonding material; 19, a diffusion plate; 20, a heater; 21, hydrogen or organic substance gas; 22, carrier gas; 23, a moisture reduction filter; 24, a gas flow rate controlling device; 25*a* to 25*f*, valves; 26, a vacuum pump; 27, a vacuum gage; 28, a piping; 30, an drawing wiring; 32, a driver formed of a power supply and a current control system; 31, a connection wiring for connecting the drawing wiring 30 and the driver of the electron source substrate; 33, an opening of the diffusion plate 19; and 41, a heat conductive member.

The supporting member 11 is used to hold and fix the electron source substrate 10, and has an electron source substrate fixing holding mechanism to fix the electron source substrate 10 mechanically by such as a vacuum chucking mechanism, an electrostatic chucking mechanism or a fixing jig. Inside the supporting member 11 a heater 20 is provided, and when necessary the electron source substrate 10 may be heated through the heat conductive member 41.

The heat conductive member 41 is provided on the supporting member 11, and is sandwiched between the supporting member 11 and the electron source substrate 10 so as not to obstruct the electron source substrate fixing and holding mechanism. The heat conductive member 41 may be buried in the supporting member 11 so as not to obstruct the electron source substrate fixing and holding mechanism.

The heat conductive member 41 is pressure contacted to the supporting member 11 by the electron source substrate fixing and holding mechanism to absorb the warp and distortion of the electron source substrate 10. Simultaneously, the heating in the electrical processing step of the electron source substrate 10 is promptly and surely performed to the supporting member 11 or the sub-vacuum container 14 (refer to FIGS. 4 and 5) described later and heat is radiated, thereby preventing damage to the electron source substrate 10 due to crack generation or the like and contributing to improvement of yield. Further, by briskly and surely conducting the heat from the electrical processing step to the supporting member 11 and releasing heat, it contributes to the reduction of nonuniform concentration distribution of introduction gas of a nonuniform temperature distribution and to the reduction of non-uniformity of device characteristics due to nonuniform temperature distribution of the electron source substrate 10, and it becomes possible to manufacture the electron source excellent in uniformity of electron-emitting characteristics of each device.

As a heat conductive member 41, a viscous liquid substance such as silicone grease, silicone oil and gel substances may be used. In a case that a heat conductive member 41 which is a viscous liquid substance moves on the supporting member 11, which is a harmful influence, an accumulator mechanism may be provided onto the supporting member 11, in order that a viscous liquid substance accumulates in a predetermined position or region, namely so that it accumulates at least below the region for forming the conductive member 6 of the electron source substrate 10, to match that region. In this way, for example, an O-ring or a viscous liquid substance may be input to a heat resistant bag to construct a sealed heat conductive member 41.

In a case that the viscous liquid substance is made to accumulate by the provision of such as an O-ring, and where it does not contact properly because an air layer is formed in between the electron source substrate 10, there is a method of injecting a viscous liquid substance in between the electron source substrate 10 and the supporting member 11 after provision of through holes for releasing air or the electron source substrate 10. FIG. 3 is a schematic cross sectional view of a device provided with an O-ring 13*a* and a viscous liquid substance introducing duct 13*b* so that the viscous liquid substance accumulates in the predetermined region.

The heater 20 is a sealed pipe and a temperature adjusting medium is sealed therein. Note that, if the viscous liquid substance is sandwiched between the supporting member 11 and the electron source substrate 10, and a mechanism for circulation whilst conducting temperature control is added, it becomes a heating means or a cooling means of the electron source substrate 10 in substitute of the heater 20. Further, for example, a mechanism consisting of such as a circulation type temperature adjustment device and a liquid medium which performs temperature adjustment for an objective temperature may be added.

Figure 15:
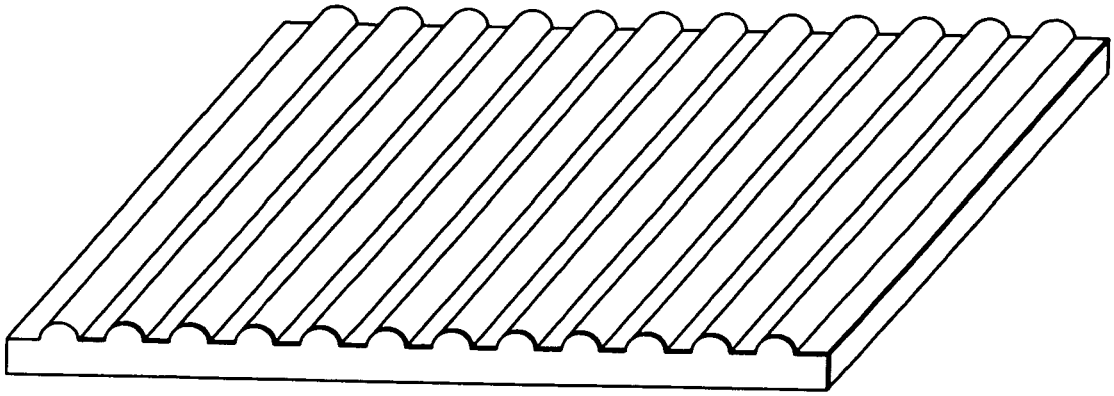
FIG. 15 is a perspective view showing the shape of a heat conductive member used in the apparatus for manufacturing the electron source in accordance with the present invention.
Figure 16:
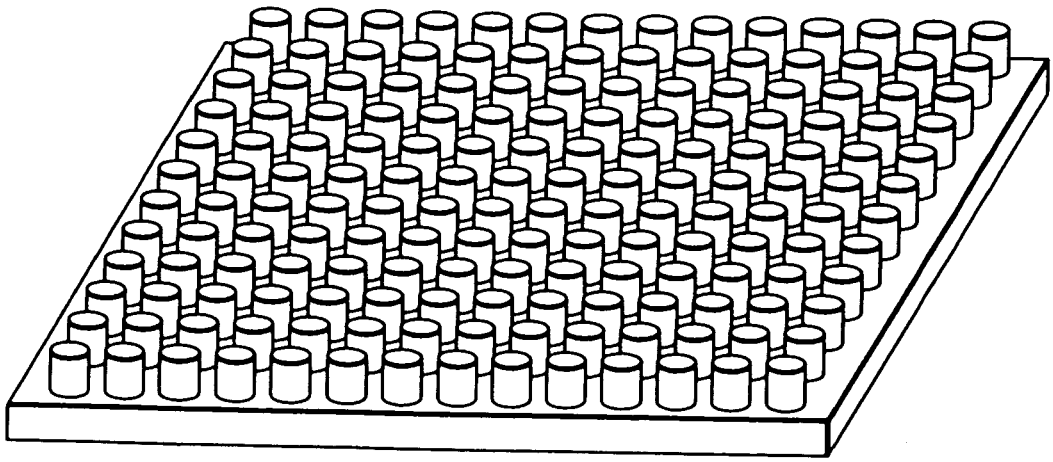
FIG. 16 is a perspective view showing another mode of the shape of the heat conductive member used in the apparatus for manufacturing the electron source in accordance with the present invention.

The heat conductive member 41 may be a resilient member. As material for a resilient member, a synthetic resin material such as teflon resin, a rubber material such as silicone rubber, a ceramic material such as alumina, a metallic material such as copper or aluminum, or the like may be used. These may be used as a sheet or as a divided sheet. Alternatively, as shown in FIGS. 15 and 16, a columnar shape such as a cylindrical shape and prismatic, a projected shape such as a linear shape or a conical shape extending in an X direction or a Y direction along the wiring of the electron source substrate, a sphere or a spherule member such as a rugby ball shape (en ellipse spherule), or a spherule member formed with a projection on the spherule member surface and the like may be provided on the supporting member.

Figure 17:
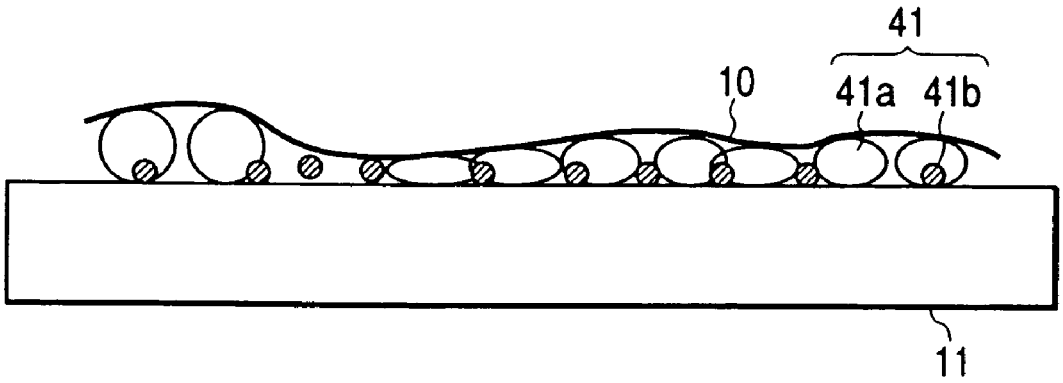
FIG. 17 is a cross-sectional view showing a of the heat conductive member in which spherical materials made of rubber are used in the apparatus for manufacturing the electron source in accordance with the present invention.

FIG. 17 is a schematic structural view in a case a plurality of micro spherule member (sphere or ellipse) are used as the heat conductive member 41. In this case, the soft micro spherule member 41*a* which is easily deformed and formed of, for example, rubber material and a hard micro spherule member 41*b* which has a smaller diameter than that of the soft micro spherule member 41*a*, is formed of, for example, a hard synthetic resin material, metallic material, ceramic material or the like and is hardly deform than the soft micro spherule member 41*a* is dispersed between the electron source substrate 10 and the supporting member 11 to be sandwiched, to thereby structure the heat conductive member 41.

Figure 18:
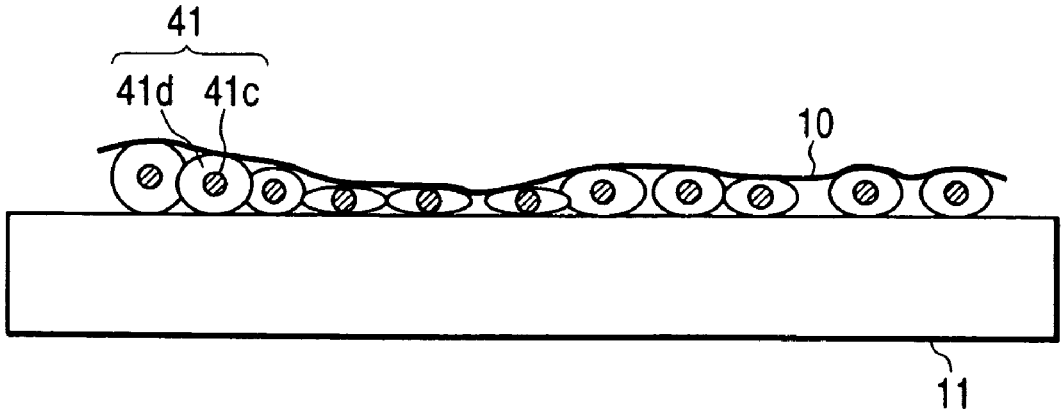
FIG. 18 is a cross-sectional view showing another mode of the heat conductive member in which spherical materials made of rubber are used in the apparatus for manufacturing the electron source in accordance with the present invention.

FIG. 18 is a schematic structural view in a case a micro spherule member of a composite material is used as the heat conductive member 41. The heat conductive member 41 shown in the figure which is a micro spherule member is, for example, the one in which the surface of a hard central portion 41*c* made of a hard material such as a hard synthetic resin material, a metallic material, or a ceramic material is coated with a soft surface portion 41*d*, for example, a rubber material etc.

When using the micro spherule member which easily moves on the supporting member 11 as the heat conductive member 41, an accumulator mechanism such as described when using the viscous liquid substance, is preferred to be provided on the supporting member 11.

Further, when a resilient member is used as the heat conductive member 41, convex and concave shapes may be formed on the surface opposing the electron source substrate 10. The convex concave shapes are preferably columnar, linear, projections, spherical (semi-spherical) and the like. Specifically, as shown in FIG. 15, it is preferable that a linear concave and convex shape substantially aligned with the position of the X directional wiring 7 (refer to FIG. 2) and the Y directional wiring 8 (refer to FIG. 2) of the electron source substrate 10 and, as shown in FIG. 16, the columnar concave and convex shape substantially aligned with the position of each device electrode and a semi-spherical concave and convex shape (not shown), are formed on the surface of the electron source substrate 10.

The vacuum container 12 is, for example, a glass or a stainless container, and is preferred to be made of material with little outgassing. The vacuum container 12 covers a region where a conductive member 6 is formed except the drawing wiring 30 portion of the electron source substrate 10, and has a structure which can withstand a pressure range of at least from $1.33\times10^{-1}$ Pa to the atmospheric pressure.

The seal-bonding material 18 is used to maintain the air tightness between the electron source substrate 10 and the vacuum container 12, and can use, for example, an O-ring, a rubber sheet or the like.

As the organic substance gas 21, an organic substance used for activation of the electron-emitting device described later or a mixture gas with an organic substance diluted with such as nitrogen, helium or argon is used. Further, when a current apply process of forming, described later, is performed, a gas for promoting fissure formation to the conductive film, for example, hydrogen gas having a reduction property or the like may be introduced into the vacuum container 12. Introduction of gas into the vacuum container 12 may be performed by connecting a gas source for introducing a gas into the vacuum container 12 to the gas introducing path 15.

Organic substances which can be used for activation of the electron-emitting device, include, for example, aliphatic hydrocarbon group of alkane, alkene and alkyne, aromatic hydrocarbon group, alcohol group, aldehyde group, ketone group, amino group, nitrile group, organic acids such as phenol, carbon and sulfonate. More specifically, for example, saturated hydrocarbon represented by $CnH_2n^{+2}$ of such as methane, ethane and propane, non saturated hydrocarbon represented by a composition formula of $CnH_2n$ etc, such as ethylene, and propylene, benzene, toluene, methanol, acetaldehyde, acetone, methyl ethyl ketone, methylamine, ethylamine, phenol, benzonitrile, acetonitrile or the like.

The organic gas 21 may be used as it is, if the organic substance is a gas at room temperature, and in the case where the organic substance is a liquid or a solid at room temperature, it may be evaporated or sublimated within the container, and is used as it is or mixed with a diluted gas. As the carrier gas 22, inert gases, for example, nitrogen, argon, helium and the like may be used.

When using the organic substance gas 21 and the carrier gas 22 together, they are mixed at a certain ratio and introduced into the vacuum container 12. The flow rate and a mixing ratio of both gasses is controlled by a gas flow rate controlling device 24. The gas flow rate controlling device 24 is constructed by such as a mass flow controller and an electromagnetic valve. These mixture gases are heated to an appropriate temperature, if necessary, by a heater (not shown) provided in the periphery of the piping 28, and then introduced into the vacuum container 12 through a gas introducing path 15. The heating temperature of the mixture gases are preferably set as being equal to the temperature of the electron source substrate 10.

Note that, it is preferable to reduce moisture in the introduction gas by providing a moisture reduction filter 23 on the way of the piping 28. As a moisture reduction filter 23, for example, a moisture absorbent such as silica gel, molecular sieve or magnesium hydroxide may be used.

The mixture gases introduced into the vacuum container 12 is exhausted at a certain exhaust speed by a vacuum pump 26 through the gas exhausting path 16, to maintain constant the pressure of the mixture gas inside the vacuum container 12. The vacuum pump 26 used in the present invention is a low vacuum pump such as a dry pump, a diaphragm pump, and a scroll pump, and among them an oil free pump is preferably used.

Although depending on the kind of organic substance used in activation, the pressure of the mixture gas is preferably to be equal to or more than the pressure in which the average free path λ of the gas molecule constituting the mixture gas becomes small enough as compared to the size of the inner side of the vacuum container 12, in view of a reduction in activation process time and in an improvement of uniformity. This is namely a viscous flow region, and a pressure is from several hundred Pa (several Torr) to the atmospheric pressure.

Figure 19:
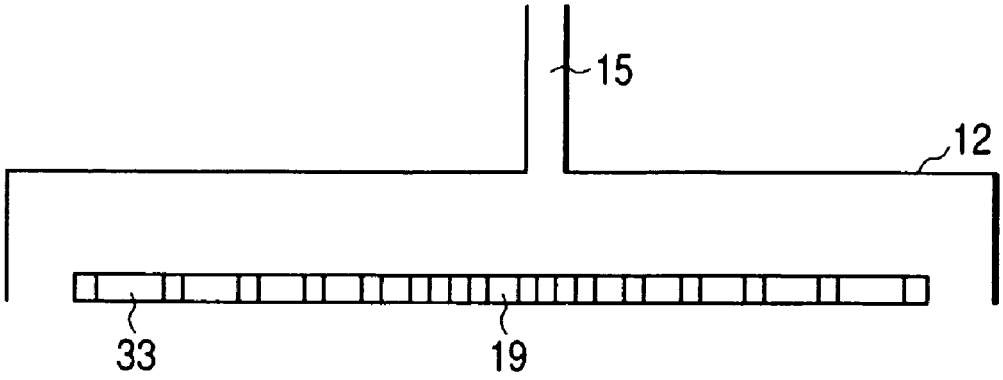
FIG. 19 is a cross-sectional view showing a shape of the diffusion plate used in the apparatus for manufacturing the electron source according to the present invention.
Figure 20:
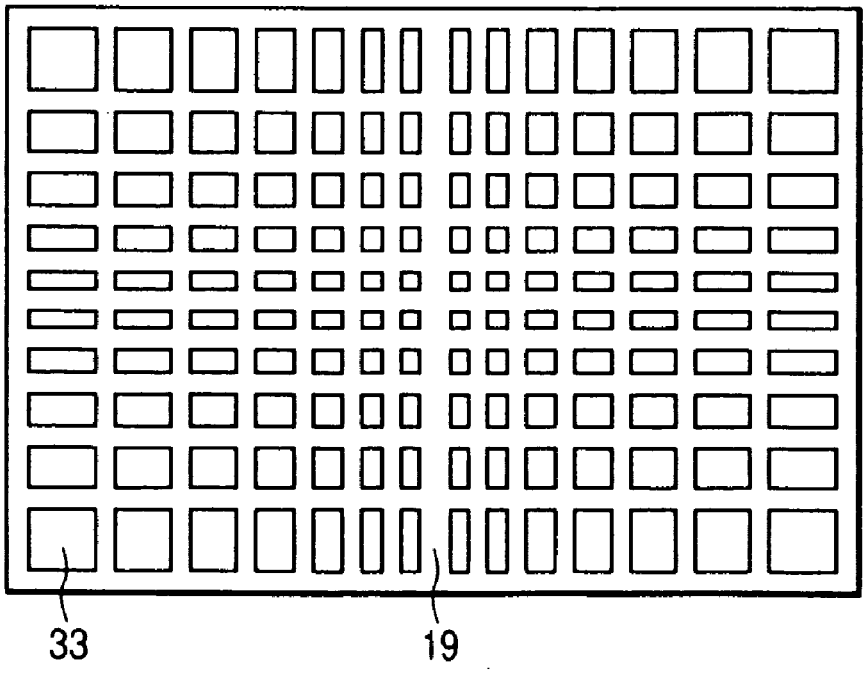
FIG. 20 is a plan view showing a shape of the diffusion plate used in the apparatus for manufacturing the electron source according to the present invention.

Further, it is preferred that the diffusion plate 19 is provided in between the opening inside the vacuum container 12 of the gas introducing path 15 (referred to as the gas introducing path) and the electron source substrate 10, so that the flow of mixture gas is controlled, and the organic substance is supplied uniformly over the entire surface of the electron source substrate 10, thereby improving the uniformity of the electron-emitting device. As the diffusion plate 19, as shown in FIGS. 1 and 3, metallic plates having an opening 33 or the like is used. As shown in FIGS. 19 and 20, the openings 33 of the diffusion plate 19 are preferably formed such that the opening area is small in the vicinity of the gas introducing port and becomes larger when it goes away from the gas introducing port, or such that the number of openings is less in the vicinity of the gas introducing port and increases when it goes away from the gas introducing port. When taking this structure, the flow rate of the mixture gas that flows inside the vacuum container 12 becomes substantially constant, thereby being capable of improving the uniformity of the characteristics of each device. However, it is important to make the diffusion plate 19 a shape that takes the characteristics of viscous flow into consideration. Accordingly, the shape is not limited to that described in this specification.

For example, the openings 33 of the diffusion plate 19 is formed concentrically at equal intervals and at equal angular intervals in a circumferential direction, and an area of the opening 33 is preferably set so as to satisfy the following equation. In this embodiment, the area of the opening 33 is set so that it becomes larger in proportion with the distance from the gas introducing port. With this, an introduction gas may be supplied to the surface of the electron substrate 10 with more uniformity, thereby the activation of the electro-emitting device may uniformly be performed.

$$Sd=S0\times[1+(d/L)2]^{1/2}$$

where d is a distance from an intersection of an extension line from the central portion of the gas introducing port and the diffusion plate 19, L is a distance from the central portion of the gas introducing port to the intersection of the extension line from the central portion of the gas introducing port and the diffusion plate 19, Sd is an area of the opening at the distance d from the intersection of the extension line from the central portion of the gas introducing port and the diffusion plate 19, and S0 is an area of the opening at the intersection of the extension line from the central portion of the gas introducing port and the diffusion plate 19.

Figure 6:
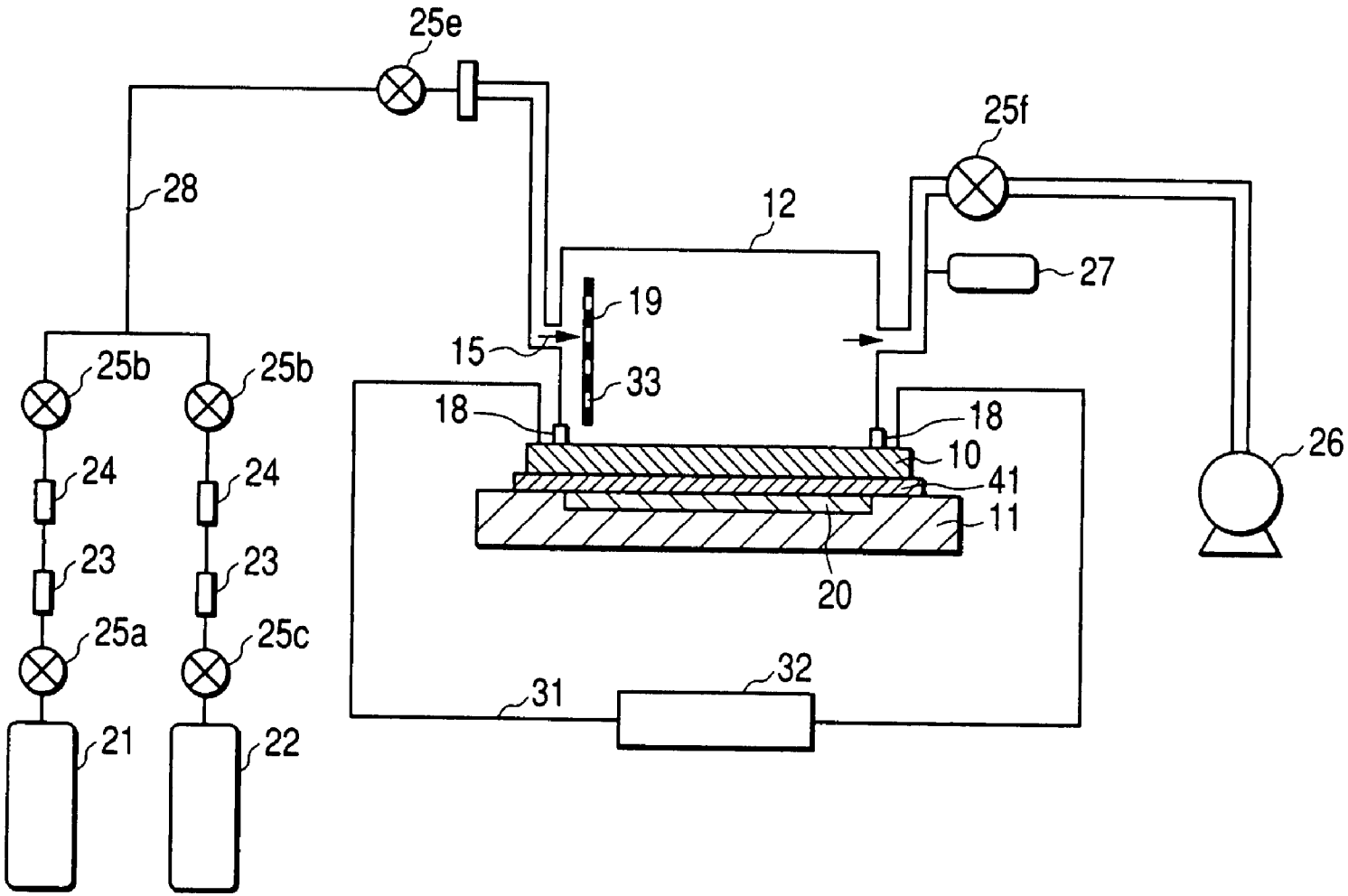
FIG. 6 is a cross-sectional view showing still another mode of the structure of the apparatus for manufacturing the electron source in accordance with the present invention.

The position of the gas introducing port and the opening inside the vacuum container 12 (referred to as exhausting port) of the gas exhausting path 16 is not limited to the mode of this embodiment and may take various modes, but in order to supply the organic substance uniformly within the vacuum container 12, the positions of the gas introducing port and the gas exhausting port are preferably provided in different positions at the top or bottom, as shown in FIGS. 1 and 3, or at the left and right, as shown in FIG. 6, and is more preferably in substantially a symmetrical position.

The drawing wiring 30 of the electron source substrate 10 extends outwardly from the vacuum container 12, and is connected to the driver 32 using a TAB wiring or a probe.

In this example, and also similar to subsequent examples described later, the vacuum container 12 needs to cover only the annex region of the conductive member 6 on the electron source substrate 10, so that a miniaturization of the device is possible. Further, since the drawing wiring 30 of the electron source substrate 10 extends to outside the vacuum container 12, the electron source substrate 10 and the power supply (driver circuit) for conducting electrical process can easily be electrically connected.

As described above, under a state a mixture gas including an organic substance is flowed into the vacuum container 12, a driver 32 is used to apply a pulse voltage to each electron-emitting device on the substrate 10 through the connection wiring 31, with the result that it is possible to conduct the activation of the electron-emitting device.

Hereinbelow, a second preferred embodiment mode of the present invention will be described. The second embodiment mode is changed mainly with respect to the supporting method of the electron source substrate 10 from the first embodiment mode, and the other structures may be the same as that in the first embodiment mode.

Figure 4:
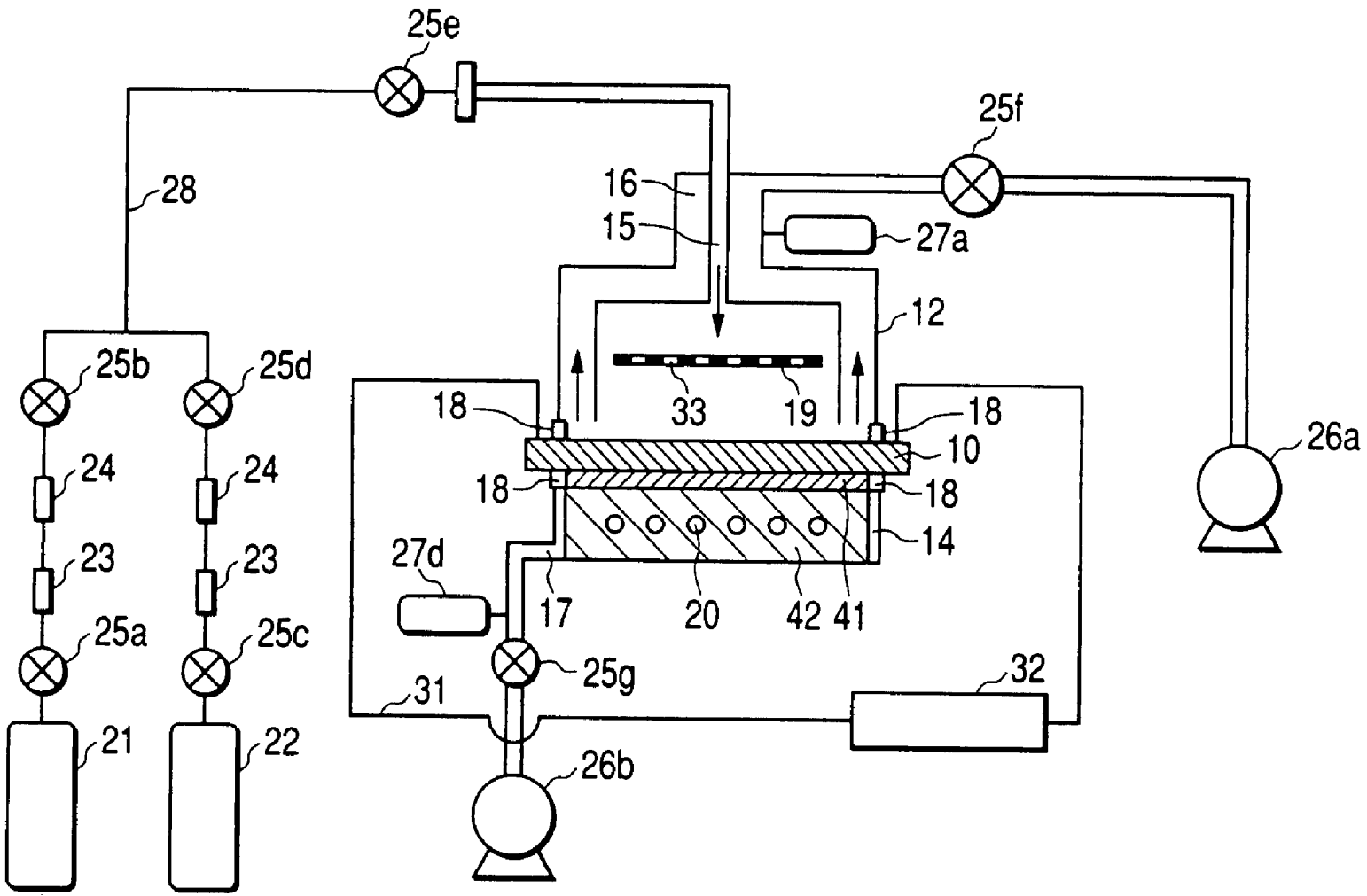
FIG. 4 is a cross-sectional view showing the structure of the apparatus for manufacturing the electron source, having an auxiliary vacuum container, in accordance with the present invention.
Figure 5:
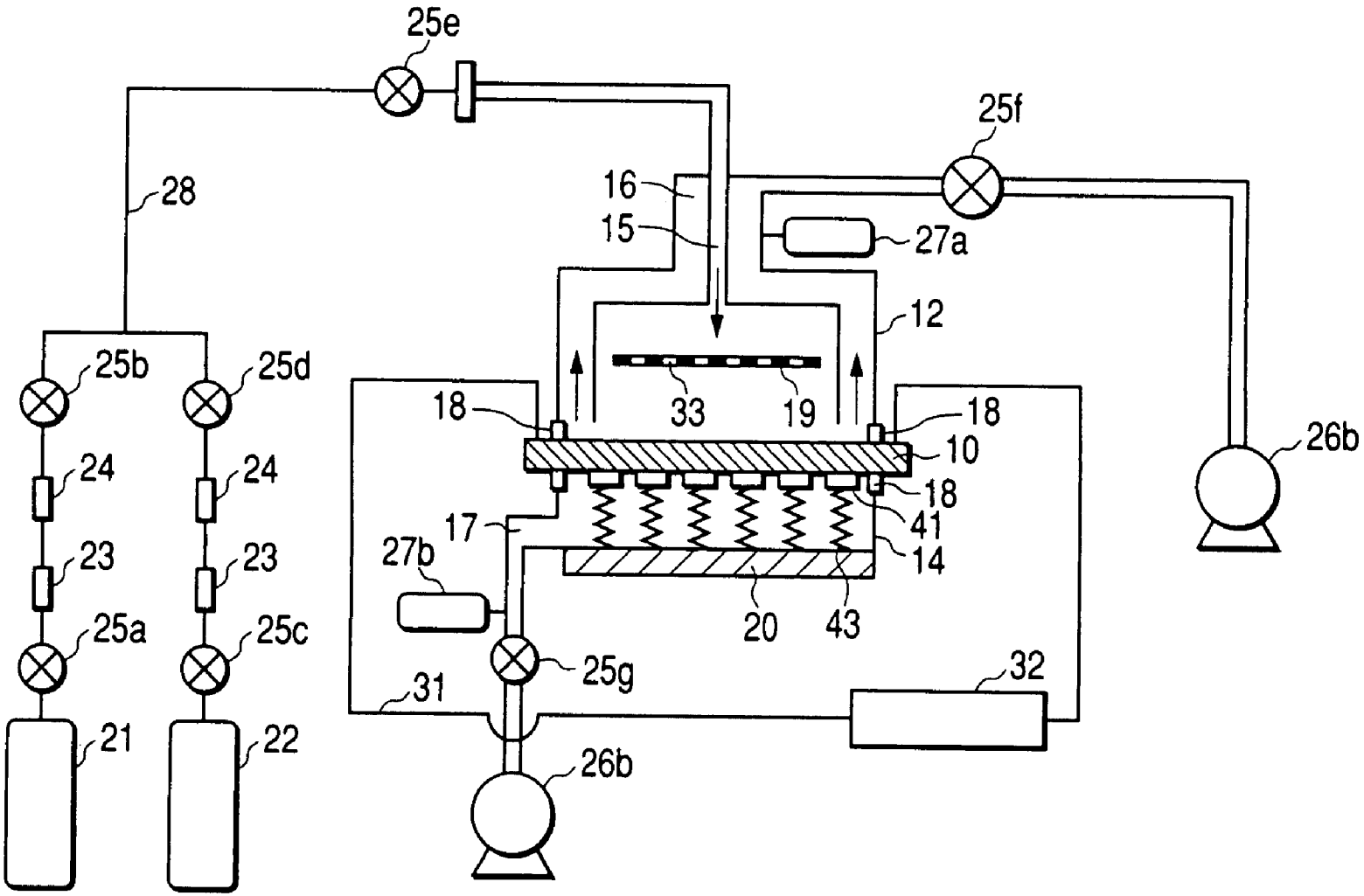
FIG. 5 is a cross-sectional view showing another mode of the structure of the apparatus for manufacturing the electron source, having the auxiliary vacuum container, in accordance with the present invention.

FIGS. 4 and 5 show a preferred second embodiment mode of the present invention. In FIGS. 4 and 5, reference numeral 14 denotes an auxiliary vacuum container, and reference numeral 17 denotes a gas exhausting path of the auxiliary vacuum container 14. The same members and the same parts as that in FIGS. 1 and 3 are shown by the same reference numerals.

In the first embodiment mode, in the case that the size of the electron source substrate 10 is large, in order to prevent the electron source substrate 10 from breaking by the pressure difference between the front surface side and the back surface side of the diffusion plate 19, namely, the pressure difference between the pressure inside the vacuum container 12 and the atmospheric pressure, it is necessary to take a measure such as making the electron source substrate 10 into a thickness which can withstand the pressure difference, or relaxing the pressure difference by using a vacuum chucking mechanism as an electron source substrate fixing holding mechanism.

The second embodiment mode is an example that keeps in mind eliminating the pressure difference or making it small so as not to be a problem when sandwiching the electron substrate 10. In the second embodiment mode, the thickness of the electron source substrate 10 can be made thin, and in the case where the electron source substrate 10 is applied to the image forming (display) apparatus, it is possible to lighten the image displaying apparatus. In this embodiment mode, the electron source substrate 10 is sandwiched and held in between the vacuum container 12 and the auxiliary vacuum container 14. The pressure within the auxiliary vacuum container 14, as a replace of the supporting member 11 in the first embodiment mode, is maintained substantially the same as the pressure within the vacuum container 12, with the result that the electron source substrate 10 can be kept horizontal.

The pressures within the vacuum container 12 and the auxiliary vacuum container 14 are set using the vacuum systems 27*a* and 27*b*, respectively. By adjusting the opening/closing degree of the valve 25*g* of the exhausting path 17 of the sub-vacuum container 14, the pressures within both vacuum containers 12 and auxiliary vacuum container 14 may be kept substantially the same.

In FIG. 4, a first heat conductive member 41 which is a sheet formed from the same material as the seal-bonding material 18 and a second heat conductive member 42 made of metal with high heat conductivity are arranged within the auxiliary vacuum container 14. The second heat conductive member 42 is used to efficiently radiate the heat from the electron source substrate 10 to the outside from the heat conductive member 41 through the auxiliary vacuum container 14. Note that, in FIGS. 4 and 5, the thickness of the auxiliary vacuum container 14 is shown as larger than its actual size to more easily understand the outline of the apparatus.

In the second heat conductive member 42, a heater 20 is buried inside to heat the electron source substrate 10, and by a control mechanism (not shown) temperature control from the outside can be performed. Further, inside the second heat conductive member 42, a tube-like sealed container for holding or circulating a fluid is incorporated, and by controlling the temperature of the fluid from the outside, the electron source substrate 10 may be cooled or heated through the heat conductive member 41. Further, a heater 20 may be provided at the bottom of the auxiliary vacuum container 14 (refer to FIG. 5) or buried inside the bottom, to provide a control mechanism (not shown) for controlling the temperature from the outside, with the result that the electron source substrate 10 can be heated through the second heat conductive member 42 and the first heat conductive member 41. Other than the above, it is possible to adjust the temperature such as heating or cooling of the electron source substrate 10 by providing means for heating or cooling to both of the inside of the second heat conductive member 42 and the auxiliary vacuum container 14.

In this embodiment mode, two kinds of heat conductive members 41 and 42 are used, however, one kind of heat conductive member, that is, either of 41 or 42, or three kinds or more of heat conductive members 41, 42, . . . may be used, and it is not limited to this embodiment mode.

The positions of the gas introducing port of the gas introducing path 15 and the gas exhausting port of the gas exhausting path 16 are not limited to those of the present embodiment mode, and may take various modes. However, in order to supply the organic substance uniformly within the vacuum container 12, the positions of the gas introducing port and the gas exhausting port are preferably provided in different positions at the top or bottom, in the vacuum container 12 as shown in FIGS. 4 and 5, or at the left and right, in the vacuum container 12 as shown in FIG. 6 of the first example, and is more preferably in substantially a symmetrical position.

In this embodiment mode, too, similar to the first embodiment mode, when there is a step of introducing a gas into the vacuum container 12, it is preferable to use the diffusion plate 19 described in the first embodiment mode with a similar mode as in the first embodiment mode. Further, a driver circuit 32 is used under a state in which a mixture gas including an organic substance flows into the vacuum container 12, and a pulse voltage is applied to each electron-emitting device on the electron source substrate 10 through the connection wiring 31, with the result that the activation of the electron-emitting device may be performed.

In this embodiment mode, too, similar to the first embodiment mode, the driver circuit 32 is used under a state in which a mixture gas including an organic substance flows inside the vacuum container 12 or in a forming process step, and a pulse voltage is applied to each electron-emitting device on the electron source substrate 10 through the connection wiring 31, with the result that the activation of the electron-emitting device can be performed.

Next, a third embodiment mode of the present invention will be described by referring to FIG. 14. In this embodiment mode, in order to prevent the deformation or the damage of the electron source substrate 10 due to the pressure difference of the front and back of the electron source substrate 10, as described above, the substrate holder 207 is provided with an electrostatic chuck 208. The fixture of the electron source substrate 10 by the electrostatic chuck 208 is performed by applying a voltage between the electrode 209 arranged in the electrostatic chuck 208 and the electron source substrate 10 to suck the electron source substrate 10 to the substrate holder 208 by electrostatic force.

In order for the electron source substrate 10 to hold the predetermined potential, there is formed a conductive film such as an ITO film on the back surface of the electron source substrate 10. Note that, for adsorption of the electron source substrate 10 by the electrostatic chuck method, it is preferable that the distance between the electrode 209 and the electron source substrate 10 is short, and therefore it is preferable that the electron source substrate 10 is once pressed onto the electrostatic chuck 208 with another method. In the apparatus shown in FIG. 14, the inside of a groove 211 formed on the surface of the electrostatic chuck 208 is exhausted to press the substrate 10 onto the surface of the electrostatic chuck 208 by the atmospheric pressure. A high voltage is applied to the electrode 209 by a high voltage power source 210 to adsorb the electron source substrate 10 sufficiently. Thereafter, even if the inside of the vacuum chamber 202 is exhausted, the pressure difference applying onto the electron source substrate 10 is canceled by the electrostatic force of the electrostatic chuck 208, thereby being capable of preventing the deformation or the damage of the electron source substrate 10.

In order to increase the heat conduction between the electrostatic chuck 208 and the electron source substrate 10, it is preferable that a gas for heat exchange is introduced into the groove 211 which has been exhausted once as described above. As the gas, He is preferable, but other gases may be effective. By introducing the gas for heat exchange, heat conduction between the electron source substrate 10 and the electrostatic chuck 208 at a portion where the groove 211 exists, not only becomes good, but also even at a portion where the groove 211 does not exist, heat conduction increases as compared to the case where the electron source substrate 10 and the electrostatic chuck 208 are thermally contacted by a simple mechanical contact. Therefore, overall heat conduction is greatly improved. With this, heat generated on the electron source substrate 10 easily moves to the substrate holder 207 through the electrostatic chuck 208 during the process of such as forming or activation, so that temperature rise of the electron source substrate 10 and generation of temperature distribution by local heat generation may be suppressed, as well as being able to control with precision the temperature of the electron source substrate 10 by providing the temperature control means such as a heater 212 and a cooling unit 213 on the substrate holder 207.

Figures 21A, 21B, 21C:
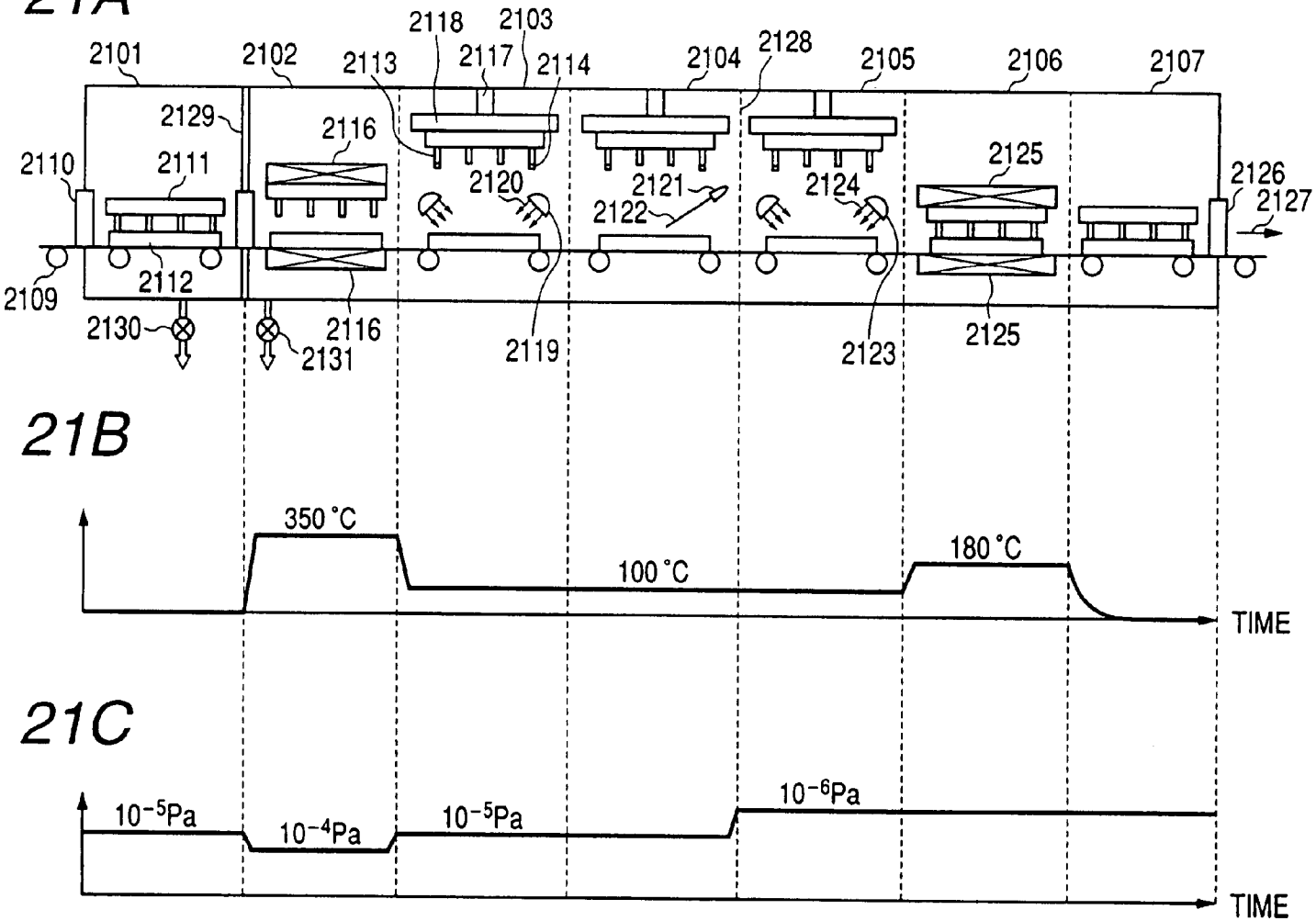
FIGS. 21A, 21B and 21C are schematic cross-sectional views of a first apparatus in accordance with an example of the present invention.

The electron source substrate formed in accordance with the first embodiment mode to the third embodiment mode is fabricated into a displaying apparatus by the method described below. FIG. 21A schematically illustrates the manufacturing apparatus in accordance with the present invention; FIG. 21B shows a temperature profile of an RP2111 consisting of the electron source substrate 10 and/or an FP2112 having phosphors formed thereon, in which a process temperature is indicated on a vertical axis with respect to time on a horizontal axis; and FIG. 21C shows a vacuum degree profile in which a vacuum degree is indicated on a vertical axis with respect to time on a horizontal axis. One example of a manufacturing method and a manufacturing apparatus in accordance with the present invention will be hereinafter described with reference to these drawings.

In an apparatus shown in FIG. 21A, a front chamber (pre-process chamber) 2101, a baking process chamber 2102, a first stage gettering process chamber 2103, an electron beam cleaning process chamber 2104, a second stage gettering process chamber 2105, a seal-bonding process chamber 2106 and a cooling chamber 2107 are arranged one by one in a carrying direction (arrow 2127 in FIG. 21A). An RP 2111 and an FP 2112 serially pass through each chamber in the direction of an arrow 2127 by means of driving a carrying roller 2109. Various kinds of processings are subjected thereto during the passage. That is, the steps of: a preparation under the vacuum atmosphere in the front chamber 2101; a baking process in the baking process chamber 2102; a first gettering process in the first stage gettering process chamber 2103; cleaning by electron beam irradiation in the electron beam cleaning process chamber 2104; a second gettering process in the second stage gettering process chamber 2105; heat seal-bonding in the seal-bonding process chamber 2106; and a cooling process in the cooling chamber 2107 are performed, respectively, on an in-line serially connected.

Preferably, a heat shielding member 2128 (in a plate form, a film form, etc.) formed of reflective metal such as aluminum, chromium and stainless steel is preferably disposed between the respective chambers. The heat shielding member 2128 may be disposed between chambers with different temperature profiles shown in FIG. 21B, for example, either between the baking process chamber 2102 and the first stage gettering process chamber 2103 or between the second stage gettering process chamber 2105 and the seal-bonding process chamber 2106 or optimally both, but may be disposed between the respective chambers. In addition, the heat shielding member 2128 is disposed so that it does not hinder the FP 2112 mounted on the carrying belt 2108 and the RP 2111 fixed onto an elevator 2117 when they moves between the respective chambers.

A gate valve 2129 is disposed between the front chamber 2101 and the baking process chamber 2102 shown in FIG. 21A. The gate valve 2129 conducts an open/close operation between the front chamber 2101 and the baking process chamber 2102. In addition, a vacuum exhausting system 2130 is connected to the front chamber 2101 and a vacuum exhausting system 2131 is connected to the baking process chamber 2102. Also, the vacuum exhausting systems 2130 and 2131 may be connected to any process chambers, respectively other than the front chamber 2101 and the baking process chamber 2102.

After carrying the RP 2111 and the FP 2112 in the front chamber 2101, a carrying-in port 2110 is shielded, and at the same time, the gate valve 2129 is shielded, thereby vacuum exhausting inside the front chamber 2101 by the vacuum exhausting system 2130. During this process, insides of all of the baking process chamber 2102, the first stage gettering process chamber 2103, the electron beam cleaning process chamber 2104, the second stage gettering process chamber 2105, the seal-bonding process chamber 2106 and the cooling chamber 2107 are vacuum exhausted by the vacuum exhausting system 2131 to bring them into a vacuum exhausted state.

When the front chamber 2101 and other chambers following the front chamber 2101 has reached the vacuum exhausted state, the gate valve 2129 is opened, the RP 2111 and the FP 2112 are carried out of the front chamber 2101, and then carried in the baking process chamber 2102. The gate valve 2129 is shielded after completing carrying in the RP 2111 and FP 2112, and then the carrying-in port 2110 is opened. Another RP 2111 and FP 2112 are carried in the front chamber 2101 again, and the inside of the front chamber 2101 is subject to the vacuum exhausting by the vacuum exhausting system 2130. The above-mentioned steps are repeated.

In the present invention, it is preferable to dispose a gate valve (not shown) identical with the gate valve 2129. The gate valve may be disposed between the respective chambers, but it is preferable to dispose the gate valve between the chambers with different vacuum degrees of a vacuum degree profile shown in FIG. 1C, for example, either between the baking process chamber 2102 and the first stage gettering process chamber 2103 or between the electron beam cleaning chamber 2104 and the second stage gettering process chamber 2105 or optimally both.

Note that in the vacuum degree profile shown in FIG. 21C, the vacuum degree of the second stage gettering process chamber 2105 becomes higher in comparison withe the electron beam cleaning chamber 2104. However, the vacuum degrees of both chambers may be set substantially identical with each other. Besides, in FIG. 21C, too, the vacuum degree of the second gettering process chamber 2105 is substantially equal to that of the seal-bonding process chamber 2106. However, the vacuum degree of both chambers may be set as different ones from each other. In the case of setting the vacuum degree of the second stage gettering process chamber 2105 as being different from that of the seal-bonding process chamber 2106, it is generally preferable that the vacuum degree of the seal-bonding chamber 2106 is set higher than that of the second stage gettering process chamber 2105. However, on the contrary, the vacuum degree of the second stage gettering process chamber 2105 may be set higher than the other. In addition, in the temperature profile shown in FIG. 21B, the temperature of the seal-bonding process chamber 2106 becomes higher than that of the second stage gettering process chamber 2105. However, the temperature profile of the seal-bonding process chamber 2106 is preferably as low as possible within a range of capable of performing the seal-bonding process. Therefore, the temperatures in both chambers may be set substantially equal to each other, or may be set reversely.

In the present invention, it is preferable to fixedly provide an outer frame for seal-bonding a vacuum structure and a spacer 2115 forming an anti-atmosphere structure in the RP 2111 in advance before carrying it into the front chamber 2101. In a position corresponding to the outer frame 2113 of the FP 2112, a seal-bonding material 2114 using a low melting point material such as frit glass or a low melting point metal such as indium, or an alloy thereof may be provided. In addition, as illustrated, the seal-bonding material 2114 may be provided in the outer frame 2113.

Heating process (baking process) by a heating plate 2116 is applied to the RP 2111 and the FP 2112 carried in the baking process chamber 2102 without being exposed to the atmosphere in the baking process chamber 2102. With this baking process, impurity gasses such as a hydrogen gas, steam and oxygen contained in the RP 2111 and the FP 2112 can be discharged. A baking temperature at this time is generally 300° C. to 400° C., preferably 350° C. to 380° C. A vacuum degree at this point is approximately $10^{-4}$ Pa.

The RP 2111 and the FP 2112 completing the baking process are carried in the first stage gettering process chamber 2103, the RP 2111 is fixed onto a holder 2118 and moved to the upper part of the chamber 2103 with the elevator 2117, a getter material flash 2120 of a evaporable getter material (e.g., a getter material made of barium, etc.) contained in a getter flash apparatus 2119 is generated with respect to the FP 2112, thereby depositing a getter film (not shown) consisting of a barium film or the like on the surface of the FP 2112. In this case, a film thickness of the first stage getter is generally 5 nm to 500 nm, preferably 10 nm to 100 nm, more preferably 20 nm to 50 nm. Besides, in the present invention, a getter film or a getter material consisting of a titanium material, an NEG material or the like may be provided on the RP 2111 or the FP 2112 in advance other than the above-mentioned getter material.

As the holder 2118, an appliance that can be fixed by a force sufficient for the RP 2111 not to drop, for example, an appliance utilizing a electrostatic chuck method or a mechanical chuck method may be used.

The RP 2111 fixed onto the holder 2118 is elevated to a position sufficiently distant from the FP 2112 on the conveying roller 2109 by the elevator 2117. At this time, an interval between the RP 2111 and the FP 2112 is preferably an interval sufficient for maximizing conductance between both substrates, although it depends on a size of a used vacuum chamber. The interval between both substrates is generally sufficient if it is 5 cm or more. In addition, in the above-mentioned step, if a barium getter is used, a process temperature of the fist stage gettering process chamber is set at approximately 100° C. A vacuum degree thereof is $10^{-5}$ Pa.

In the figure, the FP 2112 is only shown as irradiating the getter flash 2120. However, in the present invention, it is also possible to give a getter by irradiating a getter flash 2120 similar to the above-mentioned one to the RP 2111 only or both of the RP 2111 and the FP 2112. In addition, the first getter flash may be performed within the baking process chamber 2102 in order to increase vacuum degree of the vacuum atmosphere in and after the baking process in the baking process chamber 2102.

Subsequently, the RP 2111 and the FP 2112 are carried in the electron beam cleaning process chamber 2104 without being exposed to the atmosphere, and the RP 2111 and/or the FP 2112 is scanned with an electron beam 2122 by an electron beam irradiating apparatus 2121 in the electron beam cleaning process chamber 2104. In particular, impurity gasses in the phosphor (not shown) of the FP 2112 are discharged. Upon carrying in the RP 2111 and the FP 2112, as an interval between the RP 2111 held on the elevator 2117 and the FP 2112 held on the conveying roller 2109, the interval in the previous first stage gettering process step is preferably maintained without change.

Although only the FP 2112 is shown as being subjected to the electron beam cleaning process, in the present invention, it is also possible to apply electron beam cleaning process similar to the above-mentioned one to the RP 2111 only or both of the RP 2111 and the FP 2112. Further, the electron beam cleaning process is more effective as the temperatures of the RP2111 and/or FP2112 are high to some extent. Therefore, the electron beam cleaning process may be performed just after the baking process in place of the first stage gettering process.

After the above-mentioned electron beam cleaning process, the RP 2111 and the FP 2112 are carried in the second stage gettering process chamber 2105 without being exposed to the atmosphere, thereby generating a getter flash 2124 from the getter flash apparatus 2123 by a method similar to that of the first stage gettering process chamber 2103 and giving getter to the FP 2112. In giving getter to the FP 2112, a film thickness of a second stage getter is generally 5 nm to 500 nm, preferably 10 nm to 100 nm, more preferably 20 nm to 50 nm. In carrying in the RP 2111 and the FP 2112, as an interval between the RP 2111 held on the elevator 117 and the FP 2112 held on the conveying roller 2109, the interval in the previous first stage gettering process step is preferably maintained without change. In addition, a second stage getter may be given only to the RP 2111 or may be given to both of the FP 2112 and the RP 2111 in the similar manner as the first stage getter.

The RP 2112 to which the second stage getter is given and the RP 2111 positioned in the upper part of the second stage gettering process chamber 2105 by the elevator 2117 are lowered, thereby carrying them in the next seal-bonding process chamber 2106 without being exposed to the atmosphere. In this step, the elevator 2117 is operated such that the spacer 2115 and the outer frame 2113 is arranged in opposing positions until the spacer 2115 and the outer frame 2113 contacts with each other while orienting the electron beam emitting devices and the phosphors which are arranged in matrix and are provided with the RP 2111 and the FP 2112 on the respective substrates toward inside.

A heating plate 2125 is caused to act on the RP 2111 and the FP 2112 that are arranged in opposing positions in the seal-bonding process chamber 2106, and if the seal-bonding material 2114 provided in advance is made of a low melting point metal such as indium, the seal-bonding material 2114 is heated until the low melting point metal melts, or if the seal-bonding material 2114 is made of a non-metal low melting point material such as frit glass, the seal-bonding material 2114 is heated up to a temperature at which the low melting point material is softened and takes on adhesiveness. In FIG. 21B, the temperature is set at 180° C. as an example in which indium is used as the seal-bonding material 2114.

A vacuum degree in the seal-bonding process chamber 2106 may be set high at $10^{-6}$ PA or more. Thus, a vacuum degree of a display panel sealed by the RP 2111, the FP 2112 and the outer frame 2113 may also be set as high at $10^{-6}$ Pa or more. In addition, in the case where the seal-bonding process may be performed at a low temperature (if the seal-bonding process may be performed at a temperature within the second stage gettering process chamber 2105), the seal-bonding process is carried out without a time interruption after the second stage gettering process is completed, and in order to enhance the vacuum degree of the obtained display panel, the seal-bonding process may be performed withing the second stage gettering process chamber 2105.

A display panel produced in the seal-bonding process chamber 2106 is carried out to the next cooling chamber 2107 and cooled slowly.

The apparatus of the present invention is provided with a gate valve (not shown) similar to the gate valve 2110 between the seal-bonding chamber 2106 and the cooling chamber 2107, and when the gate valve is opened, the display panel is carried out of the seal-bonding process chamber 2106, the gate valve is shielded after carried in the cooling chamber 2107, the carrying-out port 2126 is opened after slow cooling, the display panel is carried out from the cooling chamber 2107, and lastly the carrying-out port 2126 is shielded to complete all the processes. In addition, before starting the next process, inside of the cooling chamber 2107 is preferably set in a vacuum state by a vacuum exhausting system (not shown) that is independently disposed.

Further, according to the present invention, inert gas such as argon gas or neon gas, or hydrogen gas may be contained in each of the chambers 2101 through 2107 under low pressure.

The above-mentioned embodiment mode is a best mode, and as a first modification example, there is given a case in which the chambers are provided in series so as to proceed the processes in the order of preparation under the vacuum atmosphere in the front chamber 2101, a first gettering process in the first stage gettering process chamber, heat seal-bonding in the seal-bonding process chamber 2106, and a cooling process in the cooling chamber 2107.

As a second modification example, there is exemplified a case in which the chambers are provided in series so as to proceed the processes in the order of preparation under the vacuum atmosphere in the front chamber 2101, baking process in the baking process chamber 2102, heat seal-bonding in the seal-bonding process chamber 2106, and cooling process in the cooling chamber 2107.

AS a third modification example, there is given a case in which the chambers are provided in series so as to proceed the processes in the order of preparation under the vacuum atmosphere in the front chamber 2101, baking process in the baking process chamber 2102, first gettering process in the first stage gettering process chamber, heat seal-bonding in the seal-bonding process chamber 2106, and cooling process in the cooling chamber 2107.

As a fourth modification example, there is given a case in which the RP 2111 and the FP 2112 are conveyed by separate conveyor means.

Figure 22:
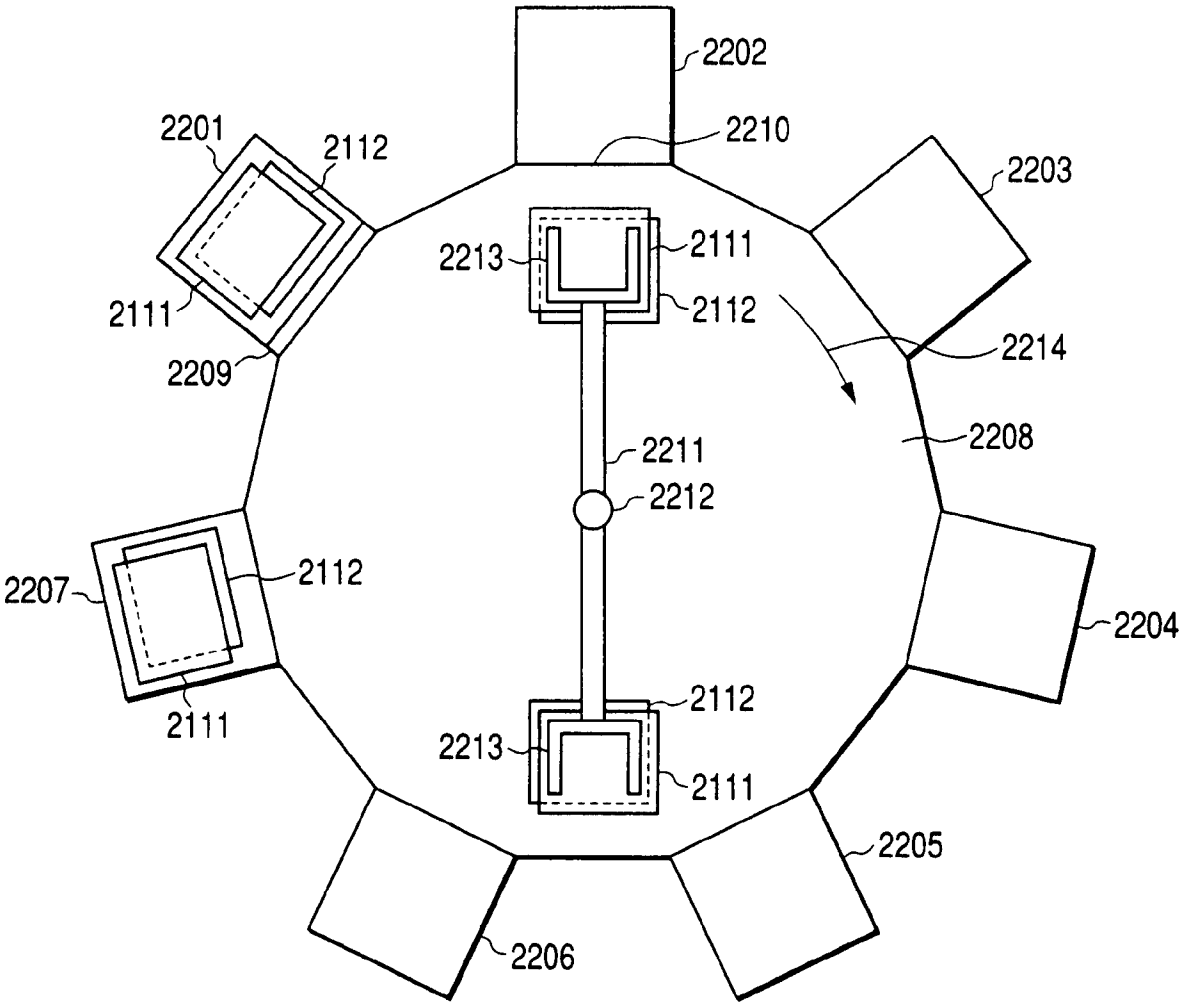
FIG. 22 is a schematic plan view showing a second apparatus in accordance with another example of the present invention.

FIG. 22 is a schematic plan view of an apparatus in which a front chamber 2201, a baking process chamber 2202, a first stage gettering process chamber 2203, an electron beam cleaning process chamber 2204, a second stage gettering process chamber 2205, a seal-bonding process chamber 2206 and a cooling chamber 2207 are provided around a central vacuum chamber 2208 in a star arrangement. The chambers 2201 through 2207 are partitioned by an independent chamber, respectively.

In the apparatus of FIG. 22, a gate valve 2209 is provided between the front chamber 2201 and the central vacuum chamber 2208. However, similar gate valves may be used for the other chambers 2202 to 2207, so that all the chambers 2201 through 207 and the central vacuum chamber 2208 can be partitioned by the gate valves. In addition, instead of the gate valve provided between the baking process chamber 2202 and the central vacuum chamber 2208, a heat shielding material 2210 may also be used. Further, similarly, in place of the gate valves provided between the other chambers 2203 to 2207 and the central vacuum chamber 2208, respectively, heat shielding materials 2210 may also be used.

In the central vacuum chamber 2208, a conveyor hand 2211 is provided, and conveyor hands 2213 are provided on both ends thereof, which enable the RP 2111 and the FP 2112 to be fixed thereonto by the electrostatic chuck method or the mechanical chuck method. The conveyor hands 2213 are provided onto a conveyor bar 2211 that is rotatable about a rotational shaft.

By repeating carrying in and carrying out of the RP 2111 and the FP 2112 for the respective chambers 2201 to 2207 in accordance with the operation of the conveyor hand 2213, each process step may be performed in each chamber. In this case, both substrates on the RP 2111 and the FP 2112 may be subjected to all the processes. However, it is preferred that one of substrates on both substrates of the RP 2111 and the FP 2112 may be subjected to a predetermined process only. For example, instead of subjecting both substrates on the RP 2111 and the FP 2112 to all the processes as described above, it is also possible to carry in only the FP 2112 in the first stage gettering process chamber 2203 and the second stage gettering process chamber 2205, to thereby apply the gettering process only to the FP 2112. During the process, the RP 2111 is allowed to stand by in the central vacuum chamber 2208, to thereby omit the gettering process to the RP 2111.

Further, according to the present invention, inert gas such as argon gas or neon gas, or hydrogen gas may be contained in each of the chambers 2201 to 2207 and the central vacuum chamber 2208 under a low pressure.

Figure 23:
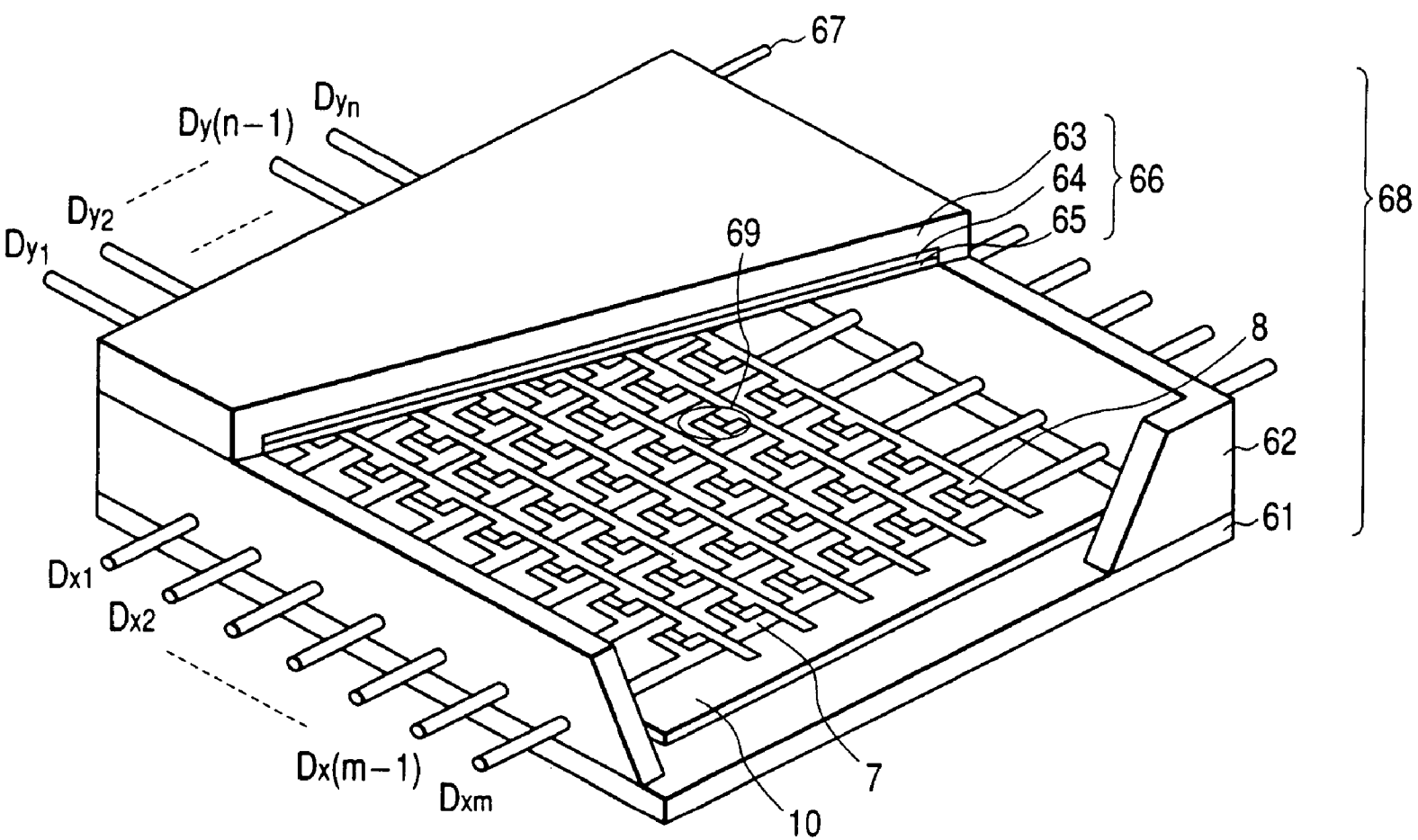
FIG. 23 is a perspective view in which a part of the structure of the image displaying apparatus is broken.

An image displaying apparatus shown in FIG. 23 may be formed by combining the electron source and the image forming material described above. FIG. 23 is a schematic view of the image displaying apparatus. In FIG. 23, reference numeral 69 denotes electron emitting devices; 61, an RP onto which the electron source substrate 10 is fixed; 62, a supporting member; 66, an FP consisting of a glass substrate 63, a metal back 65, and a phosphor 64; 67, a high voltage terminal; and 68, an image displaying apparatus.

In the image displaying apparatus, each electron-emitting device is applied with a scanning signal and a modulating signal by signal generating means (not shown) through the container external terminals Dx1 to Dxm, Dy1 to Dyn, to emit electrons. By applying a high voltage of 5 kV to the metal back 65 or the transparent electrode (not shown) through the high voltage terminal 67, the electron beam is accelerated and is allowed to collide with the phosphor film 64. The electron beam is then excited to cause a light emission. As a result, image can be displayed.

Note that there is a case in which the electron source substrate 10 itself serves as the RP, thereby being constructed by one substrate. Besides, in the case where the number of the devices is the one which has no influence on the applied voltage drop between the electron-emitting devices close to or far from the container external terminal Dx1, for example, the scanning signal wiring may be a one side scanning wiring as shown in FIG. 23. However, if the number of devices is large, thereby existing the influence of the voltage drop, technique may be taken such as enlarging the Width of the wiring, making the wiring copy thicker, or applying a voltage from both sides.

EMBODIMENTS

The present invention will be explained in detail with reference to specific embodiments below. However, the present invention is not limited to those embodiments, but includes substitutes of each element and change of design within the scope in which the object of the present invention is achieved.

Embodiment 1

Figure 24:
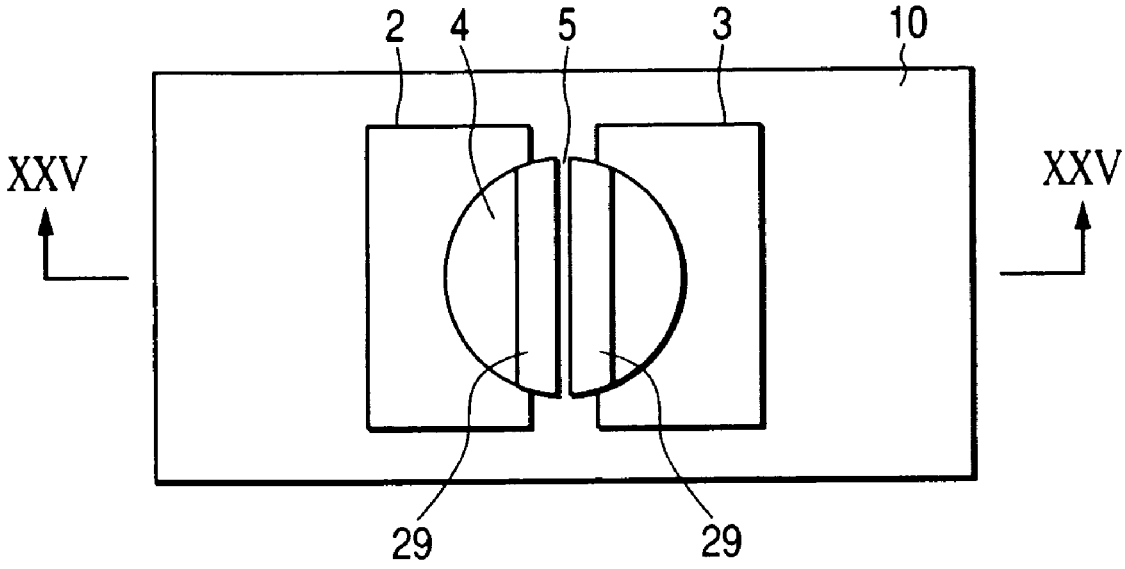
FIG. 24 is a plan view showing the structure of an electron-emitting device according to the present invention.
Figure 25:
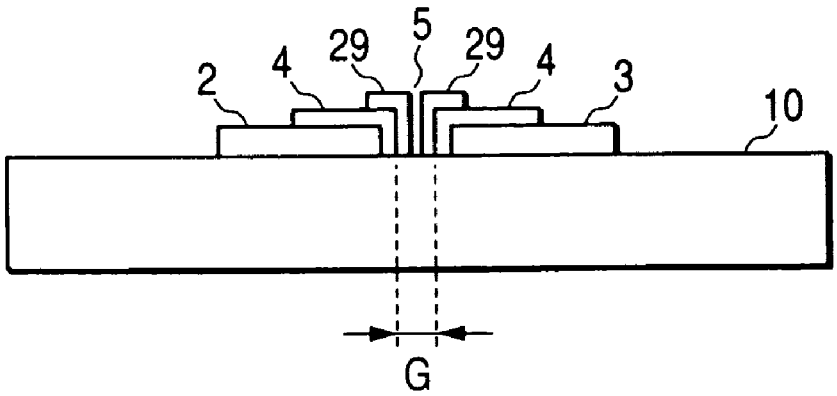
FIG. 25 is a cross-sectional view along the line of XXV-XXV in FIG. 24 showing the structure of the electron-emitting device according to the present invention.
Figure 26:
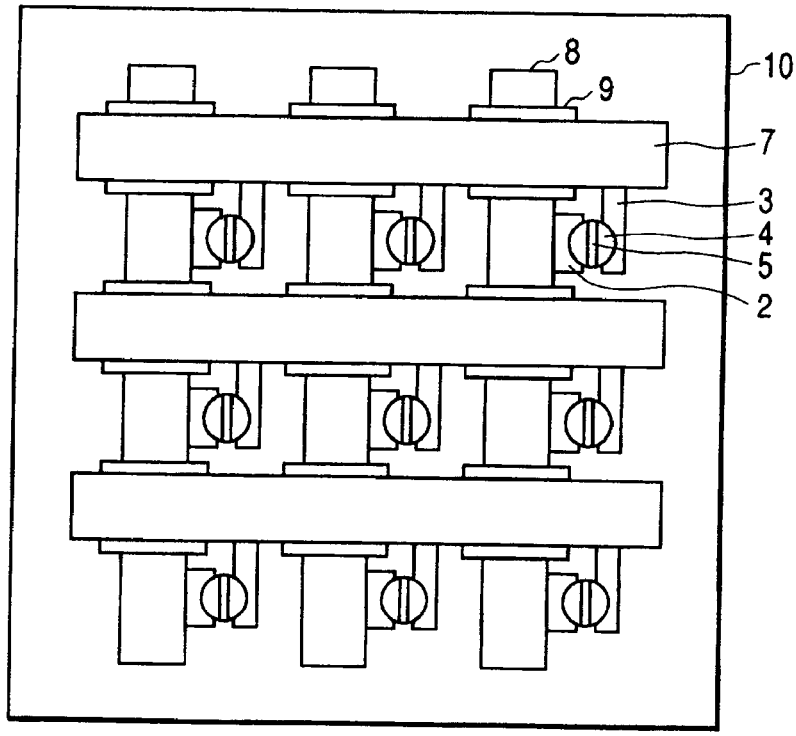
FIG. 26 is a plan view showing the electron source of the present invention.
Figure 27:
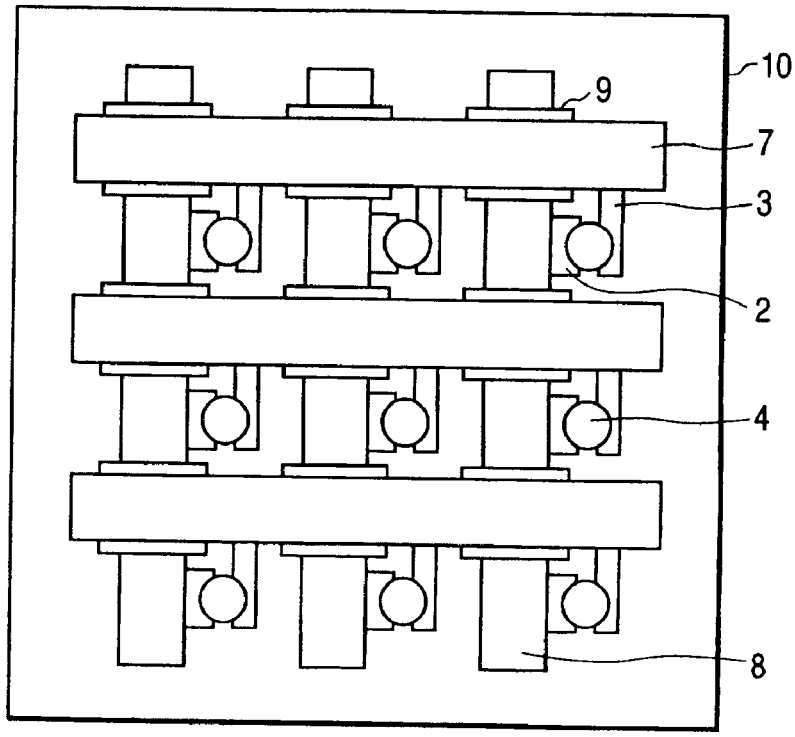
FIG. 27 is a plan view for illustrating a manufacturing method of the electron source in accordance with the present invention.

In this embodiment, an electron source shown in FIG. 26 having a plurality of surface conduction electron-emitting devices shown in FIGS. 24 and 25 is formed using the manufacturing apparatus according to the present invention. Note that, in FIGS. 24 and 25, reference numeral 10 is an electron source substrate; 2 and 3, device electrodes; 4, an electroconductive film; 29, a carbon film; 5, a gap of a carbon film 29; and character G is a gap of the electroconductive film 4. On the glass substrate (a size of 350×300 mm, a thickness of 5 mm) forming an $SiO_2$ layer thereon, a Pt paste is printed by an offset printing method, and by subjecting the substrate to heating and baking, the device electrodes 2 and 3 are formed into a thickness of 50 nm as shown in FIG. 27. Besides, by a screen printing method, Ag paste is printed on the substrate, and the heating and baking are carried out to form an X directional wiring 7 (240) and a Y directional wiring 8 (720) as shown in FIG. 27. At the intersection portion of the X directional wiring 7 and the Y directional wiring 8, insulating paste is printed by a screen printing method, and heating and baking is performed thereto to form an insulating layer 9.

Next, a bubble jet injecting apparatus is used to drop a palladium complex solution in between the device electrodes 2, 3, and the electroconductive film 4 shown in FIG. 27 is formed from palladium oxide particulates by heating it for 30 minutes at 350° C. The film thickness of the electroconductive film 4 was 20 nm. As in then way described above, the electron source substrate 10 is formed, in which a plurality of conductive members formed from a pair of the device electrodes 2, 3 and the electroconductive film 4 are formed into a matrix wiring with the X directional wiring 7 and the Y directional wiring 8.

From an observation of warp and waviness of the electron source substrate 10, it was found that, due to the warp and waviness which the electron source substrate 10 itself inherently owns and the warp and waviness of the electron source substrate 10 which may caused by the above heating process, the periphery of the substrate 10 is in a state of being warped about 0.5 mm with respect to the central portion of the electron source substrate 10.

The formed electron source substrate 10 is fixed onto a supporting member 11 of the manufacturing apparatus shown in FIGS. 1 and 2. In between the supporting member 11 and the electron source substrate 10 is sandwiched a heat conductive rubber sheet 41 of a thickness of 1.5 mm.

Subsequently, a stainless vacuum container 12 as shown in FIG. 2 is provided on the electron source substrate 10 so that the drawing wiring 30 goes outside the vacuum container 12 through a silicone rubber seal-bonding material 18. On the electron source substrate 10 is provided a metal plate formed with an opening 33 as a diffusion plate 19 as shown in FIGS. 19 and 20.

A valve 25*f* on a gas exhausting path 16 side is opened, and the inside of the vacuum container 12 is vacuum exhausted by a vacuum pump 26 (here, a scroll pump) to approximately $1.33\times10^{-1}$ Pa ($1\times10^{-3}$ Torr). Then, to remove moisture thought to be attached to the piping and the electron source substrate of the exhausting apparatus, a heater for piping and a heater 20 for the electron source substrate 10 (not shown) are used to raise the temperature up to 120° C., to maintain it for two hours and then slowly cool down to room temperature.

After the temperature of the electron source substrate 10 has been returned to room temperature, a voltage is applied to between the device electrodes 2 and 3 of the respective electron-emitting devices 6, through the X directional wiring 7 and the Y directional wiring 8, using a driver circuit 32 connected to a drawing wiring 30 through the wiring 31 shown in FIG. 2, and an activation process is performed to form a gap G shown in FIG. 25 in the electroconductive film 4.

Subsequently, an activation process is performed using the same apparatus. As shown in FIG. 1, a valve 25*a* to 25*d* for supplying a gas and a valve 25*e* on a gas introducing path 15 side are opened, and a mixture gas of an organic substance gas 21 and a carrier gas 22 are introduced into the vacuum container 12. A 1% ethylene mixed nitrogen gas is used as the organic substance gas 21, and a nitrogen gas is used as the carrier gas 22. The flow rate of the respective gases are 40 sccm and 400 sccm. The opening/closing degree of the valve 25*f* is adjusted whilst looking at the pressure of the vacuum system 27 on the gas exhaust path 16 side, to thereby make the pressure within the vacuum container 12 into $1.33\times10^{2}$ Pa (100 Torr).

An activation process was performed by applying a voltage to between the device electrodes 2 and 3 of the respective electron-emitting devices 6, through the X directional wiring 7 and the Y directional wiring 8 using the driver circuit 32, for 30 minutes after the introduction of an organic substance gas. The voltage is controlled so as to rise from 10 V to 17 V within about 25 minutes, the pulse width is set to 1 msec, the frequency is set to 100 Hz, and the activation time is set as 30 minutes. Note that, the activation is performed by a method of connecting the unselected lines of all the Y directional wirings 8 and the X directional wiring 7 in common to the Gnd (ground potential), and selecting the 10 lines of the X directional wiring 7. The pulse voltage of 1 msec is sequentially applied to the line one by one. The above method is repeated to perform the activation process of all the lines in the X direction. Since the above method was used, the activation for all the lines took 12 hours.

When a device current If (current flowing between the device electrodes of the electron-emitting device) at the time of activation process completion is measured for each X directional wiring, and the device currents If are compared, the value was approximately 1.35 A to 1.56 A, and the average was 1.45 A (corresponds to approximately 2 mA per one device), the fluctuation for each wiring is approximately 8% and a good activation process could be performed.

The electron-emitting device subjected to the above activation process is formed with a carbon film 29 with the gap 5 as shown in FIGS. 24 and 25.

Further, at the time of the activation process, an analysis of the gas is performed on the gas exhausting path 16 side using a mass spectrum measurement apparatus (not shown) with a differential exhausting apparatus. At the same time as introduction of the above mixture gas, the nitrogen and ethylene mass No. 28 and the ethylene fragment mass No. 26 are instantaneously increased and saturated, and both values were constant during the activation process. Next, an image displaying apparatus shown in FIG. 23 is manufactured using the electron source substrate 10 to which the above-mentioned processes are performed. First, the electron source substrate 10 and an outer frame 62 are fixed onto an RP 61, and this is made into an RP 2111 of FIGS. 21A to 21C. Further, an FP 66 on which a phosphor 64 and a metal back 65 are formed, and this is made into an FP 2112 of FIGS. 21A to 21C. The RP 2111 and the FP 2112 are conveyed in the manufacturing apparatus shown in FIGS. 21A to 21C, to manufacture the image displaying apparatus shown in FIG. 23 by the manufacturing apparatus of FIGS. 21A to 21C as described above.

After fixing the electron source substrate 10, similar to Embodiment 1 as shown in FIG. 27, onto the RP61, as shown in the schematic diagram of the image displaying apparatus shown in FIG. 23, the FP 66 is arranged 5 mm above the electron source substrate 10 through the supporting frame 62, an exhausting pipe (not shown) having an inner diameter of 10 mm and an outer diameter of 14 mm and a gettering material (not shown), then using frit glass, seal-bonding is performed in an argon atmosphere at 420° C.

In this way, compared to the case where the forming process step for forming the image forming apparatus mode as shown in FIG. 23 and an activating process step are performed, a required time for the manufacturing step is reduced and the uniformity of the characteristics of each electron-emitting device of the electron source is improved.

Further, the warp of the substrate, which occurs when the substrate size becomes large, is liable to invite the reduction of yield or fluctuation in characteristics. However, with the provision of the thermal conductive members according to Embodiment 1, improvement in yield and reduction of fluctuation in characteristics could be realized.

Embodiment 2

An electron source substrate 10 shown in FIG. 27 was formed similarly to Embodiment 1, and the electron source substrate 10 was provided in a manufacturing apparatus in FIG. 1. In this embodiment, after heating a mixture gas containing organic substances to 80° C. by a heater provided in the vicinity of a piping 28, the mixture gas was introduced into a vacuum container 12. Besides, the electron source substrate 10 was heated through a thermal conductive member 41 using a heater 20 in a supporting member 11 to set the substrate temperature to 80° C. An activation process was performed as in Embodiment 1 other than the above, to thereby form an electron source.

On the electron-emitting device subjected to the activation process, carbon films 29 are formed with a gap 5 as shown in FIGS. 25 and 26.

In this embodiment as well, the activation process could be performed in a short period of time as in Embodiment 1. When a device current If at the end of the activation process was measured as in Embodiment 1, the value increased about 1.2 times compared with Embodiment 1. Further, the fluctuation ratio of the device current If was about 5%, and the activation process excellent in uniformity could be performed.

The inventors of the present invention suppose that this is because a thermal distribution due to heat generation in the activation process is relaxed by heating and further, an effect to promote chemical reaction in the activation process develops by heating.

Thereafter, using the electron source substrate 10 subjected to the above processes, an image displaying apparatus shown in FIG. 23 is manufactured. First, the electron source substrate 10 and an outer frame 62 are fixed onto an PR 61, and this is made into an RP 2111 in FIGS. 21A to 21C. An FP 66 in which a phosphor 64 and a metal back 65 are formed is made into an FP 2112 in FIGS. 21A to 21C. The RP 2111 and the FP 2112 are carried in the manufacturing apparatus shown in FIGS. 21A to 21C, and as described above, an image displaying apparatus shown in FIG. 23 was manufactured by using the manufacturing apparatus in FIGS. 21A to 21C.

Embodiment 3

An electron source substrate 10 shown in FIG. 27 was formed similarly to Embodiment 1, and an electron source was formed using the manufacturing apparatus shown in FIG. 3 by the same method as in Embodiment 1 except that silicone oil was used as a thermal conductive member.

In the apparatus according to this embodiment, when silicone oil is injected into the lower portion of the substrate using a pipe for introducing viscous liquid material, a through hole (not shown) that serves for air escape and for discharging the viscous liquid material is provided at a position outside a device electrode region, which is substantially a diagonal line to the pipe. The device current value after the activation process was the same as in Embodiment 1.

Thereafter, using an electron source substrate 10 subjected to the above processes, an image displaying apparatus shown in FIG. 23 is manufactured. First, the electron source substrate 10 and the outer frame 62 are fixed onto the RP 61, and this is made into the RP 2111 in FIGS. 21A to 21C. The FP 66 in which a phosphor 64 and a metal back 65 are formed is made into the FP 2112 in FIGS. 21A to 21C. The RP 2111 and the FP 2112 are carried in the manufacturing apparatus shown in FIGS. 21A to 21C, and as described above, the image displaying apparatus shown in FIG. 23 was manufactured by using the manufacturing apparatus in FIGS. 21A to 21C.

Embodiment 4

In this embodiment, an example of manufacturing another electron source is shown. Using a glass substrate having an $SiO_2$ layer formed thereon with a thickness of 3 mm, an electron source substrate 10 shown in FIG. 27, which was manufactured in the same manner as in Embodiment 1, was provided between a vacuum container 12 and an auxiliary vacuum container 14 shown in FIG. 4 through a seal-bonding member 18 made of silicone rubber, a sheet shape thermal conductive member 41 made of silicone rubber which has a cylindrical projection on the surface that contacts the electron source substrate 10, and a thermal conductive member 42 made of aluminum which has an embedded heater therein, respectively.

Note that in this embodiment, activation process was performed without providing a diffusion plate 19, which was different from the case shown in FIG. 4.

A valve 25*f* on the side of a gas exhausting path 16 of the vacuum container 12 and a valve 25*g* on the side of a gas exhausting port 17 of the auxiliary vacuum container 14 are opened, and the vacuum container 12 and the auxiliary vacuum container 14 are exhausted to about $1.33\times10^{-1}$ Pa ($1\times10^{-3}$ Torr) with vacuum pumps 26*a* and 26*b* (here, scroll pumps).

Exhaustion is performed while maintaining the state of (pressure inside the vacuum container 12)≧(pressure inside the auxiliary vacuum container 14). In this way, the substrate deforms due to the pressure difference, and in the case that a distortion occurs, the substrate is pressed to the heat conductive member as a convex to the auxiliary vacuum container 14 side, and the heat conductive member suppresses the deformation of the substrate to thereby support the substrate 10.

In a case that the size of the electron source substrate 10 is large and the thickness of the electron source substrate 10 is thick, it becomes an opposite state, namely, it becomes a state of (pressure inside the vacuum container 12)≦(pressure inside the auxiliary vacuum container 14). When it becomes a convex state to the vacuum container 12 side, since no member exists inside the vacuum container 12, for suppressing the deformation caused by the pressure difference and for supporting the electron source substrate 10, with the result that, in the worst case, the substrate may be broken towards the vacuum container 12. In other words, the larger the size of the substrate and the thinner the thickness of the substrate, the more important the thermal conductive member which has a role as a supporting member of the substrate becomes, when the manufacturing apparatus for the electron source according to this embodiment is used.

Similar to Embodiment 1, a voltage is applied between electrodes 2 and 3 of respective electron-emitting devices 6 using a driver circuit 32 through an X directional wiring 7 and a Y directional wiring 8, and a forming process is performed on an electroconductive film 4 to form a gap G as shown in FIG. 25 on the electroconductive film 4. In this embodiment, at the same time as the voltage application, to promote the formation of fissures in the electroconductive film, hydrogen gas having a reduction property to a palladium oxide is gradually introduced into the chamber through a separate piping system (not shown) to 533×102 Pa (approximately 400 Torr).

Subsequently, an activation process is performed using the same apparatus. Valves 25*a* to 25*d* for supplying a gas and a valve 25*e* on a gas introducing path 15 side are opened, and a mixture gas of the organic substance gas 21 and the carrier gas 22 are introduced into the vacuum container 12. A 1% propylene mixed nitrogen gas is used as an organic gas 21, and a nitrogen gas is used as a carrier gas 22. The flow of the respective gases are set as 10 sccm and 400 sccm. Note that, after the mixture gases are passed through a moisture reduction filter 23, respectively, they are introduced into the vacuum container 12. The opening/closing degree of a valve 25*f* is adjusted whilst looking at the pressure of a vacuum gage 27*a* on the gas exhausting path 16 side, to thereby make the pressure within the vacuum container 12, $2.66\times10^2$ Pa (200 Torr). Simultaneously, the opening degree of the valve 25*g* on the gas exhausting port 17 side of the auxiliary vacuum container 14 is adjusted, to make the pressure within the auxiliary vacuum container 14 also $2.66\times10^2$ Pa (200 Torr).

Similar to Embodiment 1, the activation process was performed by applying a voltage between the electrodes 2 and 3 of the respective electron-emitting devices 6 using the driver circuit 32 through the X directional wiring 7 and the Y directional wiring 8. When the device current If at the time of the activation process is measured in a similar method with Embodiment 1, the device current IF is from 1.34 A to 1.53 A, and the fluctuation is approximately 7%, and therefore a satisfactory activation process could be performed.

Note that, the electron-emitting device with the above activation process completed is formed with a carbon film 29 with a gap 5 as shown in FIGS. 24 and 25.

Further, at the time of the activation process, when an analysis of the gas is performed on the gas exhausting path 16 side, using a mass spectrum measurement apparatus with a differential exhausting apparatus (not shown), at the same time as introduction of the above mixture gas, the nitrogen mass No. 28 and the propylene mass no. 42 are instantaneously increased and saturated. Both values were constant during the activation process steps.

In this embodiment, since a mixture gas including an organic substance is introduced into the vacuum container 12 provided on the electron source substrate 10 having an electron-emitting device with a viscous flow region of a pressure $2.66\times10^2$ Pa, the organic substance uniformity within the container was obtained in a short period of time. Therefore, it was possible to reduce the time needed for the activation process immensely. Next, an image displaying apparatus shown in FIG. 23 is manufactured using an electron source substrate 10 with the above processes performed. First, the electron source substrate 10 and an outer frame 62 are fixed onto an RP 61, and this is made into an RP 2111 of FIGS. 21A to 21C. Further, an FP 66 forming a phosphor 64 and a metal pack 65 is made into an FP 2112 of FIGS. 21A to 21C. The RP 2111 and the FP 2112 are conveyed in the manufacturing apparatus shown in FIGS. 21A to 21C, to manufacture the image displaying apparatus shown in FIG. 23 by the manufacturing apparatus of FIGS. 21A to 21C as described above.

Embodiment 5

In this embodiment, the apparatus shown in FIG. 4 was used similarly to Embodiment 4 other than that a diffusion plate 19 shown in FIGS. 19 and 20 was disposed in a vacuum container 12. In the same manner as in Embodiment 4, the formation of a gap G on the conductive film shown in FIG. 25 by a forming process, and an activation process therefor were performed to form an electron source.

In this embodiment as well, the activation process could be performed in a short period of time similarly to Embodiment 4. Note that the electron-emitting device subjected to the activation process is provided with a carbon film 29 with a gap 5 as shown in FIGS. 24 and 25. When a device current If at the end of the activation process was measured by the same method as in Embodiment 4, the value of the device current If was from 1.36 A to 1.50 A and the fluctuation ratio was about 5%. The activation process more excellent in uniformity could be performed.

Thereafter, using an electron source substrate 10 subjected to the above processes, the image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are formed is made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above,

Embodiment 6

In this embodiment, an activation process was performed, using the apparatus shown in FIG. 4 used in Embodiment 5 as in the same manner in Embodiment 5 except the following process: a heater 20 embedded inside a thermal conductive member 42 was used, and by controlling the heater 20 using an external controller, an electron source substrate 10 was heated through the thermal conductive members 42 and 41 into the substrate temperature of 80° C., and further, the vacuum container was heated at 80° C. by the heater provided in the periphery of a piping 28.

An electron emitting device subjected to the activation process is provided with a carbon film 29 with a gap 5 as shown in FIGS. 24 and 25.

When a device current If after completing the activation process was measured by the same method as in Embodiment 4, the value of the device current If was from 1.37 A to 1.48 A and the fluctuation ratio thereof was about 4%. The activation process could be performed satisfactorily.

Thereafter, using an electron source substrate 10 subjected to the above processes, an image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

Embodiment 7

In this embodiment, a silicone rubber sheet was used as a thermal conductive member 41, which is divided and is formed into a shape having an uneven surface in which several pieces of grooves is formed for applying a non-slippage effect onto the surface contacting with the substrate. Further, the apparatus shown in FIG. 5 in which a thermal conductive spring member 43 made of stainless steel was used, was used. A heater 20 embedded in the lower portion of an auxiliary vacuum container was controlled by an external controller (not shown), and an electron source substrate 10 was heated through the thermal conductive spring member 43 and the thermal conductive member 41. An electron source was thus formed in the same method as in Embodiment 6 except the above, with the result that the excellent electron source similar to that in Embodiment 6 could be manufactured.

Thereafter, using an electron source substrate 10 subjected to the above processes, an image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

Embodiment 8

In this embodiment, an electron source was formed by the same method as in Embodiment 7 other than that the process that was performed for 10 lines at one time was simultaneously performed twice in an activation process, that is, process for 20 lines was performed at one time. When a device current If at the end of the activation process was measured by the same method as in Embodiment 7, the value of the device current If was from 1.36 A to 1.50 A and the fluctuation ratio became somewhat larger, but was about 5%.

The inventors of the present invention suppose that this is because heat is further generated in accordance with the increase in the number of lines to be processed at one time, and a thermal distribution influences on the formation of the electron source.

In the electron source manufacturing apparatuses according to Embodiments 5 to 8, since the thermal conductive members are provided, there is obtained a great effect in manufacturing yield of an electron source substrate and improvement in the characteristic.

Embodiment 9

In this embodiment, an electron source shown in FIGS. 24 and 25 are manufactured using the manufacturing apparatus according to the present invention.

First, a Pt4 paste is printed by an offset printing method on a glass substrate on which an $SiO_2$ layer was formed, and then heated and baked, to form device electrodes 2 and 3 shown in FIG. 25 of a thickness of 50 nm. Next, an Ag paste is printed by a screen printing method thereon, and heating and baking were performed to form an X directional wiring 7 and a Y directional wiring 8 as shown in FIG. 27. An insulating paste is printed on top by the screen printing method at the intersection portion of the X directional wiring 7 and the Y directional wiring 8, to form an insulating layer 9 by heating and baking.

Next, a bubble jet method injecting apparatus is used to drop a palladium complex solution in between the device electrodes 2 and 3, and an electroconductive film 4 made from palladium oxide, which is shown in FIG. 27, is formed by heating at 350° C. for 30 minutes. The film thickness of the electroconductive film 4 was 20 nm. As described above, an electron source substrate 10 is formed, in which a plurality of conductive members consisting of a pair of device electrodes 2 and 3 and the electroconductive film 4 are formed into a matrix wiring with the X directional wiring 7 and the Y directional wiring 8.

Figure 7:
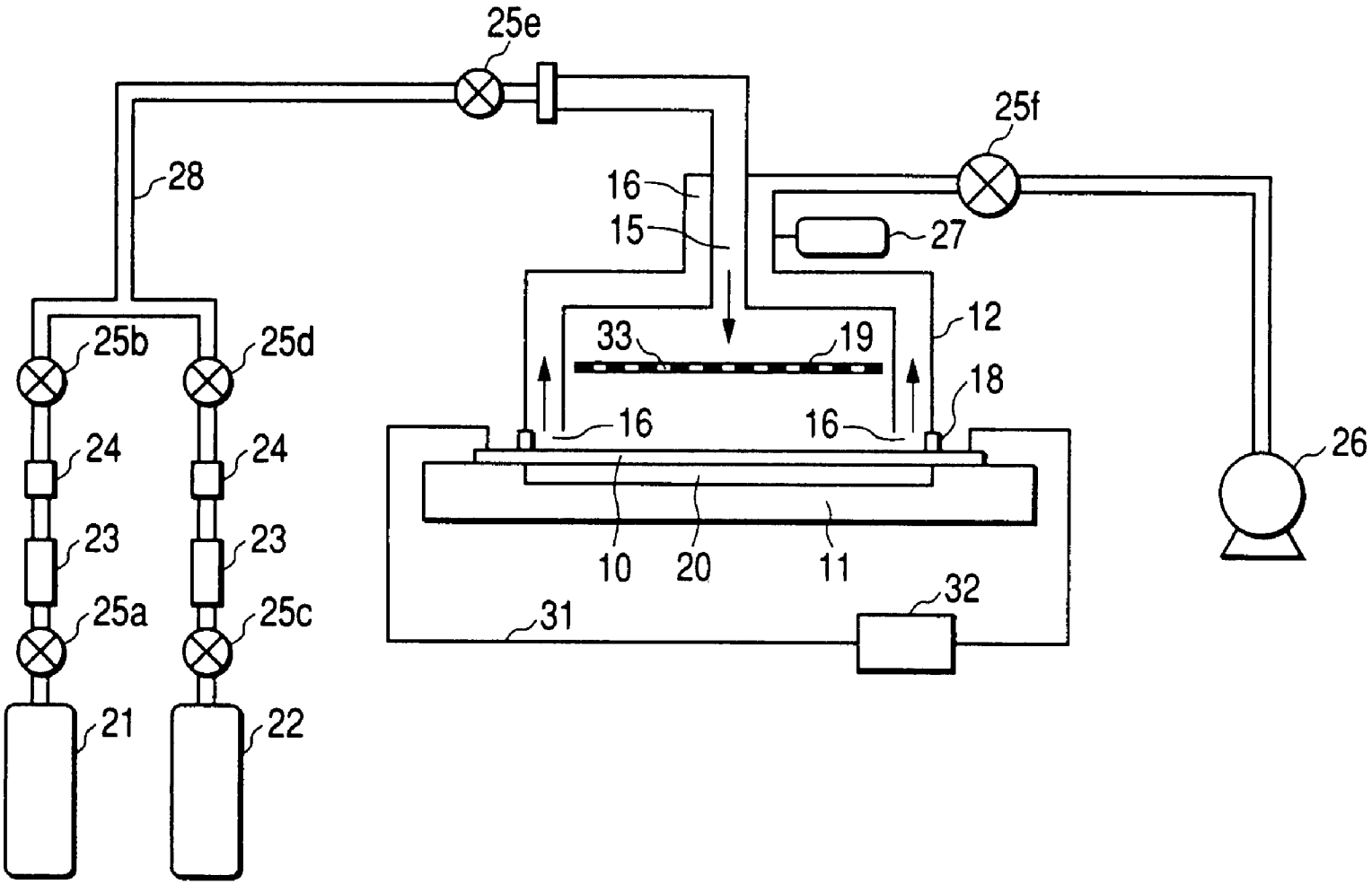
FIG. 7 is a cross-sectional view showing another mode of the structure of the apparatus for manufacturing the electron source according to the present invention.
Figure 8:
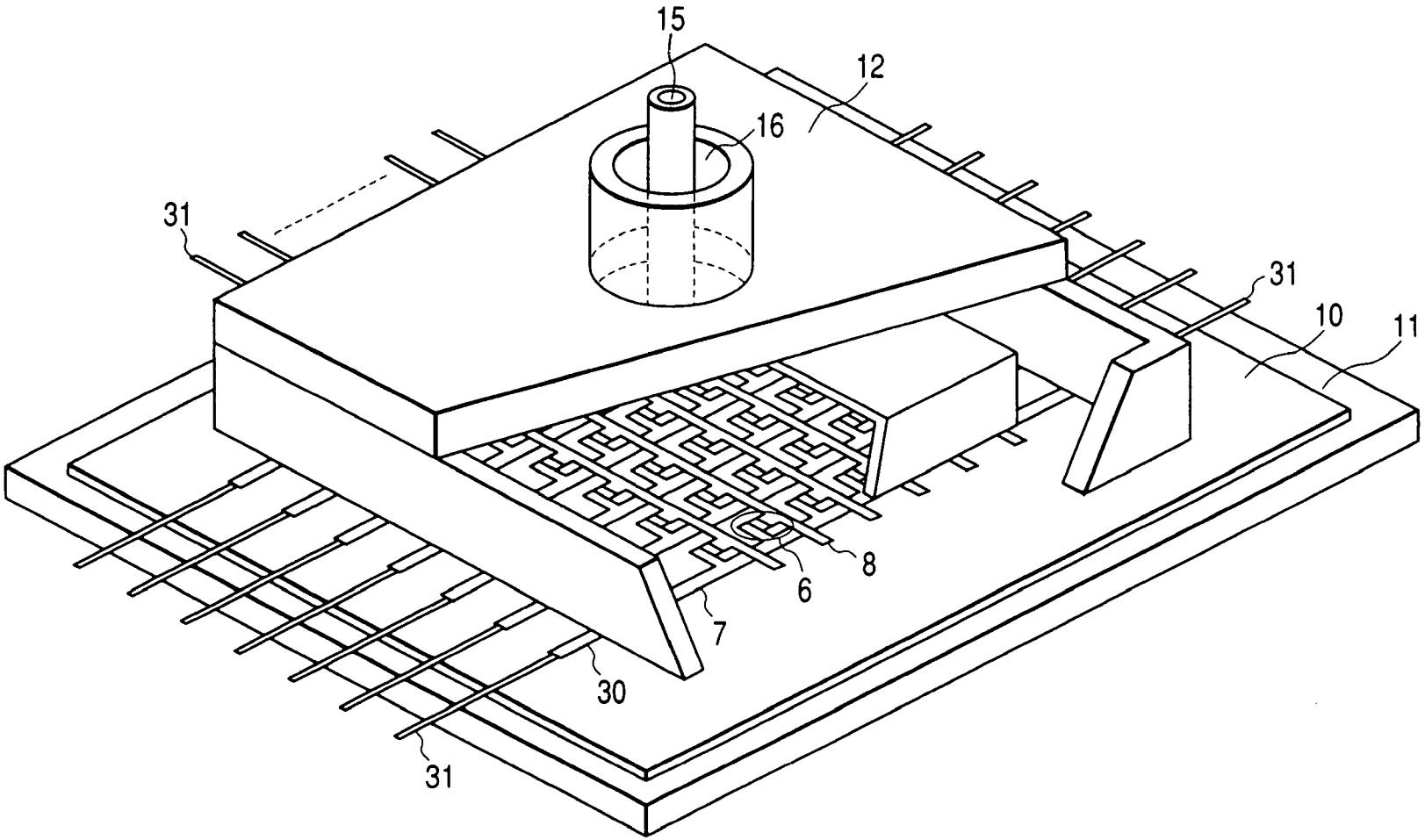
FIG. 8 is a perspective view showing a peripheral portion of the electron source substrate shown in FIG. 7.

The manufactured electron source substrate 10 shown in FIG. 27 is fixed onto a supporting member 11 of the manufacturing apparatus shown in FIGS. 7 and 8. Next, a stainless container 12 as shown in FIG. 8 is provided on the electron source substrate 10, so a drawing wiring 30 goes outside the vacuum container 12 through a silicone rubber seal-bonding material 18. On the electron source substrate 10 is provided a metal plate having an opening 33 as a diffusion plate 19. The opening 33 of the diffusion plate 19 is formed so as to be a circle with a 1 mm diameter at the central portion (intersection of an extension line from a central portion of a gas introducing port), with 5 mm intervals in the concentric circle direction, and with 50 mm intervals in the circumferential direction, and to satisfy the following equation.

$$Sd=S0\times[1+(d/L)2]½$$

where, d: a distance from an intersection of an extension line from a central portion of a gas introducing port and the diffusion plate L: a distance from the central portion of the gas introducing port, to the intersection of the extension line from the central portion of the gas introducing port and the diffusion plate Sd: an area of an opening at a distance d from the intersection of the extension line from the central portion of the gas introducing port and the diffusion plate S0: an area of the opening from the intersection of the extension line from the central portion of the gas introducing port and the diffusion plate.

A valve 25*f* on a gas exhausting path 16 side is opened, and the inside of a container 12 are vacuum exhausted by a vacuum pump 26. (here, a scroll pump) to approximately $1\times10^{-1}$ Pa. Next, a voltage is applied in between electrodes 2 and 3 of respective electron-emitting devices 6, using a drive circuit 32 through an X directional wiring 7 and a Y directional wiring 8, and a forming process is performed on an electroconductive film 4 to form a gap G shown in FIG. 25 on the electroconductive film 4.

Subsequently, an activation process using the same device is performed. In the activation process step, a valve 25*ad* for supplying gas and a valve 25*e* on the gas introducing path 15 side are opened, which are shown in FIG. 7, and a mixture gas of an organic substance gas 21 and a carrier gas 22 were introduced into a container 12. A 1% propylene mixed nitrogen gas is used as the organic substance gas 21, and a nitrogen gas is used as the carrier gas 22. The flow rate of the respective gases are set as 40 sccm to 400 sccm. The opening degree of a valve 25*f* is adjusted whilst looking at the pressure of a vacuum gage 27 on a gas exhaust path 16 side, and the pressure within the container 12 is set as $1.3\times10^4$ Pa.

Subsequently, an activation process was performed by applying a voltage between the device electrodes 2 and 3 of the respective electron-emitting devices 6, through the X directional wiring 7 and the Y directional wiring 8 using the driver circuit 32. The voltage is 17 V, the pulse width is 1 msec, the frequency is 100 Hz, and the activation time is 30 minutes. Note that, the activation is performed by a method of connecting the electron source substrate 10 as the unselected lines of all the Y directional wirings 8 and the X directional wiring 7 in common to the Gnd (ground potential), selecting the 10 lines of the X directional wiring 7, with a method of subsequently applying the pulse voltage of 1 msec per 1 line, and the above method is repeated to conduct the activation process of all the lines in the X direction.

The electron-emitting apparatus completed with the above activation process is formed with a carbon film 29 with a gap 5 as shown in FIGS. 24 and 25.

When a device current If (a current that flows between device electrodes of the electron-emitting device) at the time of activation process completion is measured for every X directional wirings, the fluctuation of the device current If is approximately 5%, and therefor an excellent activation process could be performed.

Further, at the time of the activation process, when an analysis of gas is performed on the gas exhausting path 16 side, using a mass spectrum measurement apparatus (not shown) with a differential exhausting apparatus, at the same time as introduction of the above mixture gas, the nitrogen and ethylene mass No. 28 and the ethylene fragrance mass no. 26 are instantaneously increased and saturated. Both values were constant during the activation process steps.

In this embodiment, since a mixture gas including an organic substance is introduced into the container 12 provided on the electron source substrate 10 with a viscous flow region of a pressure $1.3\times10^4$ Pa, the organic substance concentration within the container 12 could be made constant in a short period of time. Therefore, it was possible to reduce the time needed for activation process immensely.

Then, using an electron source substrate 10 subjected to the above processes, an image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

Embodiment 10

In this embodiment, an electron source substrate 10 manufactured similarly to Embodiment 9 to the step before performing the activating process is used, and the electron source substrate 10 is provided in the manufacturing apparatus of FIG. 7.

In this embodiment, a mixture gas including organic substances is heated by a heater provided in the periphery of the piping 28 to 120° C., and then introduced into the container 12. Further, the electron source substrate 10 is heated using a heater 20 within a supporting member 11, to make the substrate temperature into 120° C. Except the above, the activation process was performed similarly to Embodiment 1.

The electron-emitting elements subjected to the activation process are formed with a carbon film 29 with a gap 5 as shown in FIGS. 24 and 25.

In this embodiment as well as in Embodiment 9, the activation could be performed in a short period of time. When a device current If (a current that flows between device electrodes of the electron-emitting device) at the time of activation process completion is measured for every X directional wirings, the device current If is increased approximately 1.2 times as compared to Embodiment 1. Further, the fluctuation of the device current If was approximately 4%, and activation excellent in uniformity could be performed.

Then, using an electron source substrate 10 subjected to the above processes, an image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21*c*, and the image displaying apparatus shown in FIG. 23 was manufactured by using the manufacturing apparatus in FIGS. 21A to 21C, as described above.

Embodiment 11

Figure 9:
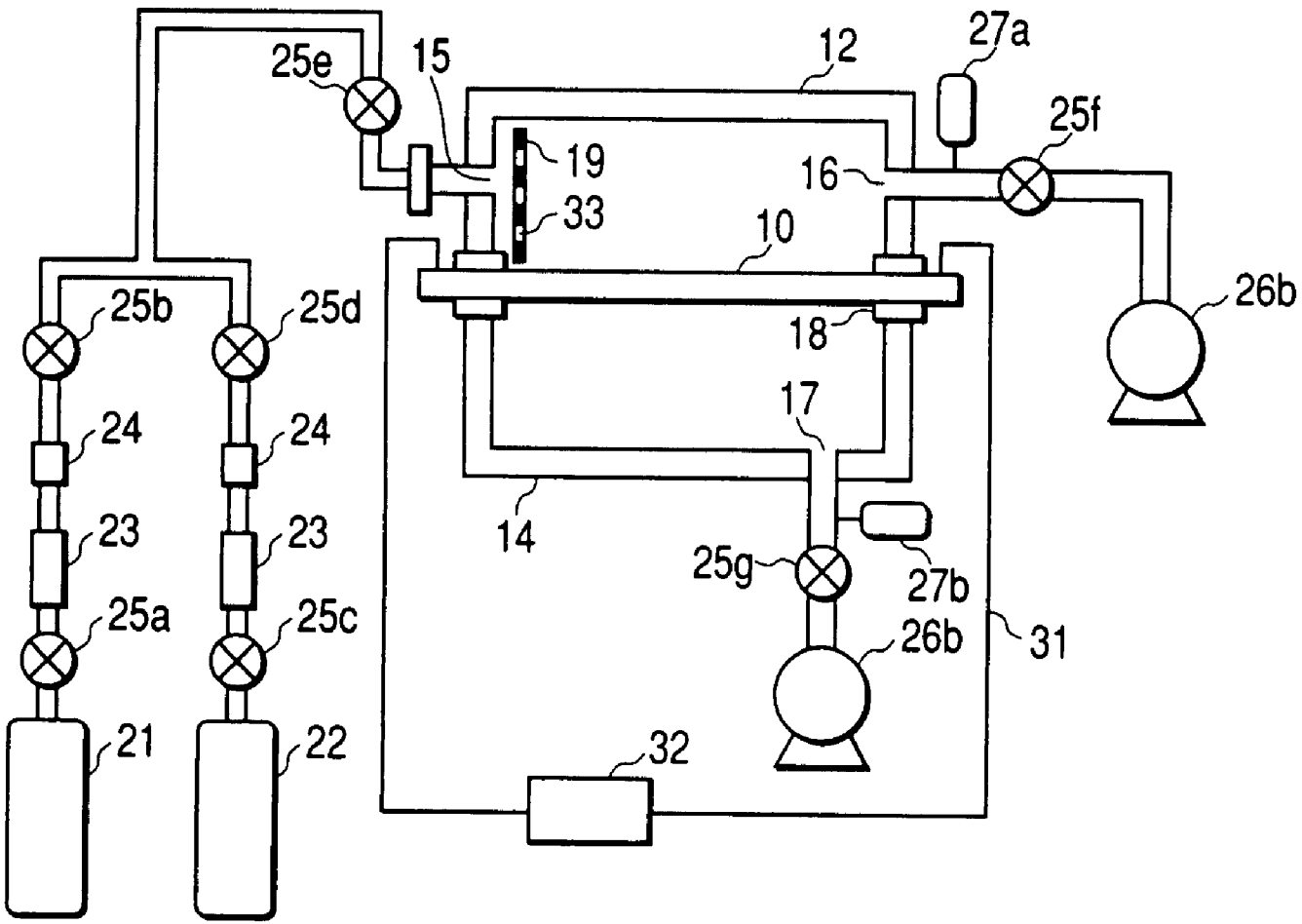
FIG. 9 is a cross-sectional view showing another example of the apparatus for manufacturing the electron source, having the auxiliary vacuum container, according to the present invention.

In this embodiment, an electron source substrate 10 as shown in FIG. 27 formed until the step of forming a electroconductive film 4 as in Embodiment 9, is provided between a first container 12 and a second container 14 of the manufacturing apparatus shown in FIG. 9, respectively through a silicone rubber seal-bonding material 18. In this embodiment, an activation process is performed without providing a diffusion plate 19.

A valve 25*f* on e gas exhaust path 16 side of the first container 12 side and a valve 25*g* on a gas exhausting path 17 side of the second container 14 is opened, and the inside of the first container 12 and the second container 14 are vacuum exhausted by vacuum pumps 26*a* and 26*b* (here, scroll pump) to approximately $1\times10^{-1}$ Pa. Next, similarly to Embodiment 1, a voltage is applied between electrodes 2 and 3 of respective electron-emitting devices 6, using a drive circuit 32 through an X directional wiring 7 and a Y directional wiring 8, a forming process is performed on an electroconductive film 4 to form a gap G shown in FIG. 25 on the electroconductive film 4.

Subsequently, an activation process using the same device is performed. In the activation process step, as shown in FIG. 9, a valve 25*ad* for supplying gas and a valve 25*e* on the gas introducing path 15 side are opened, and a mixture gas of an organic substance gas 21 and a carrier gas 22 are introduced into the first container 12. A 1% propylene mixed nitrogen gas is used as the organic substance gas 21, and a nitrogen gas is used as the carrier gas 22. The flow rate of both gases are set as 10 sccm to 400 sccm. Note that, the mixture gases are respectively introduced into the container 12 after passing through a moisture reduction filter 23. The opening degree of the valve 25*f* is adjusted whilst looking at the pressure of a vacuum gage 27*a* on the gas exhaust path 16 side, to thereby make the pressure within the first container 12 into $2.6\times10^4$ Pa.

Simultaneously, an opening degree of the valve 25*f* on the exhaust pipe 17 side of the second container 14 is adjusted, to thereby make the voltage within the second container 14 to be $2.6\times10^4$ Pa.

Next, as in Embodiment 9, a voltage is applied between the device electrodes 2 and 3 of the respective electron-emitting devices 6, through the X directional wiring 7 and the Y directional wiring 8 to conduct the activation process.

The electron-emitting elements subjected to the activation process are formed with a carbon film 29 with a gap 5 as shown in FIGS. 24 and 25.

When a device current If (a current that flows between device electrodes of the electron-emitting device) at the time of activation process completion is measured for every X directional wirings, the fluctuation of the device current If was approximately 8%.

Further, at the time of activation process, when analysis of the gas is performed on the gas exhausting path 16 side, using a mass spectrum measurement apparatus (not shown) with a differential exhausting apparatus, at the same time as introduction of the above mixture gas, the nitrogen mass No. 28 and the propylene mass No. 42 instantaneously increased and saturated. Both values were constant during the activation process steps.

In this embodiment, since a mixture gas including an organic substance is introduced into the first container 12 provided on the electron source substrate 10 with the electron-emitting device with a viscous flow region of $2.6\times10^4$ Pa, the organic substance concentration within the container could be made constant in a short time. Therefore, it was possible to reduce the time needed for the activation immensely.

Then, using an electron source substrate 10 subjected to the above processes, an image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

Embodiment 12

Figure 10A:
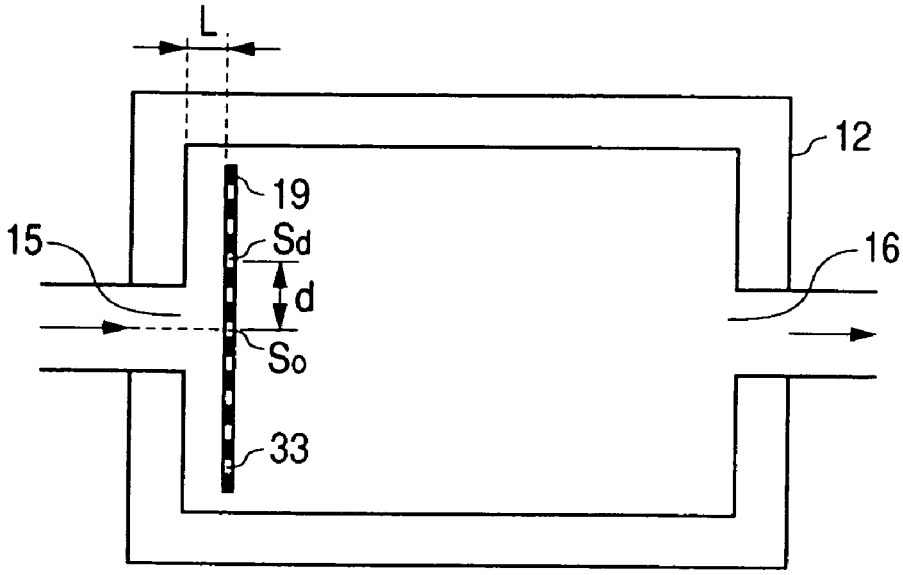
FIGS. 10A and 10B are schematic views showing the shapes of a first container and a diffusing plate shown in FIG. 9.
Figure 10B:
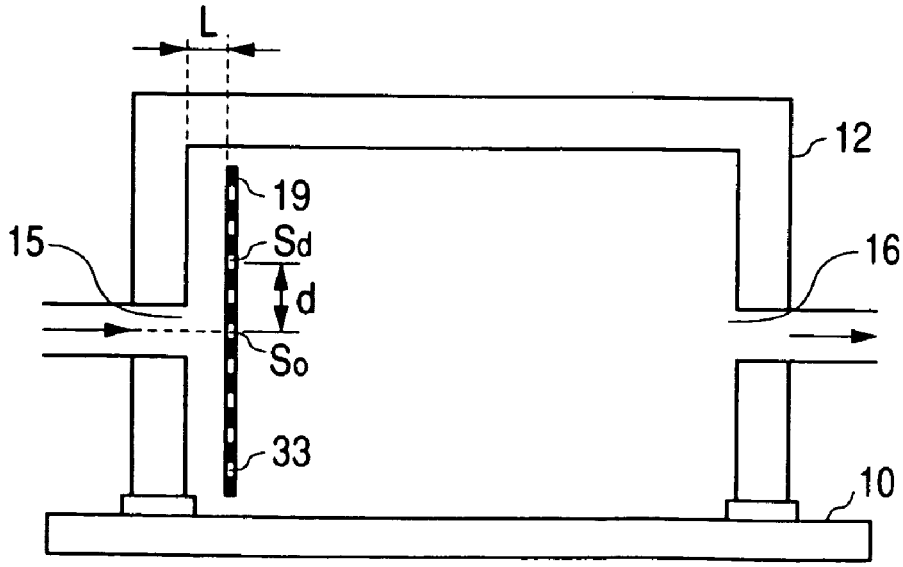

As similar to Embodiment 11, an electron source substrate 10 subjected to the processes before the activation process is used, and carried in the manufacturing apparatus of FIG. 9. In this embodiment, the activation process similar to that in Embodiment 11 is performed, excepting that a diffusion plate 19 as in FIGS. 10A and 10B are provided within the container 13.

In this embodiment, too, the electron-emitting device subjected to the activation process is formed with the carbon film 29 with a gap 5 as shown in FIGS. 24 and 25.

Note that, an opening 33 of a diffusion plate 19 has an opening in the central portion (intersection of an extension line from the central portion of the gas introducing port and the diffusion plate) as a circle with a 1 mm diameter, with 5 mm intervals in the concentric circle direction, and with 50 mm intervals in the circumferential direction to be formed to satisfy the following equation. Further, a distance L from the central portion of the gas introducing port to the intersection of the extension line from the central portion of the gas introducing port and the diffusion plate is set to 20 mm.

$$Sd=S0\times[1+(d/L)2]½$$

where, d: a distance from an intersection of an extension line from a central portion of a gas introducing port and the diffusion plate L: a distance from the central portion of the gas introducing port, to the intersection of the extension line from the central portion of the gas introducing port and the diffusion plate Sd: an area of an opening at a distance d from the intersection of the extension line from the central portion of the gas introducing port and the diffusion plate S0: an area of the opening from the intersection of the extension line from the central portion of the gas introducing port and the diffusion plate.

In this embodiment, it was possible to perform the activation in a short period of time as similar to Embodiment 11. Further, when a device current If (a current that flows between the device electrodes of the electron-emitting device) at the time of the activation process completion is measured for every X directional wirings, the fluctuation of the device current If was approximately 5%, and the activation process excellent in uniformity could be performed.

Then, using an electron source substrate 10 subjected to the above processes, an image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

Embodiment 13

In this embodiment, the image displaying apparatus shown in the figure applying the electron source formed in accordance with the present invention is manufactured.

As similar to Embodiment 10, an electron source substrate 10 subjected to the forming process and the activation process is used to manufacture the image displaying apparatus shown in FIG. 23. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

The display panel completed as described above is connected to necessary driving means to construct an image displaying apparatus. Each electron-emitting device is applied with a scanning signal and a modulating signal by a signal generating means (not shown) through the container external terminals Dx1Dxm, Dy1Dyn, to emit electrons. The electron beam is accelerated by applying a high-voltage of 5 kV to the metal back 65 or the transparent electrode (not shown) through the high-voltage terminal 67, to allow the beam collide with the phosphor film 64, and to cause excitation and light emission, thereby displaying an image.

In the image displaying apparatus in accordance with this embodiment, it is possible to display a satisfactory good image for television, which does not have luminous fluctuation or color variation by visual observation.

According to the manufacturing apparatus according to Embodiments 9 to 13, described above, it is possible to reduce the introduction time of the organic substances in the activation process, thereby reducing the manufacturing time. In addition, the high-vacuum device becomes unnecessary, so that manufacturing cost may be reduced.

Besides, according to the manufacturing apparatus described above, only a container covering the electron-emitting device portion on the electron source substrate is required. Therefore, the size reduction of the apparatus can be obtained. Moreover, since there is the drawing wiring portion of the electron source substrate outside the container, electrical connection between the electron source substrate and the driver circuit can easily be made.

Further, by using the above manufacturing apparatus, it is possible to provide an electron source excellent in uniformity and an image displaying apparatus.

Embodiment 14

The image displaying apparatus having the electron source with a plurality of surface conductive electron-emitting devices in a matrix wiring is manufactured as shown in FIG. 26. The manufactured electron source substrate 10 is arranged with 640 pixels in an X direction and 480 pixels in a Y direction in a simple matrix. Phosphors are arranged in position corresponding the respective pixels, with the result that an image displaying apparatus that can perform color display is obtained. Further, a surface conduction electron-emitting device according to the present invention is manufactured, similar to the above embodiments, by subjecting an electroconductive film made of PdO particulates to a forming process and an activation process.

Figure 11:
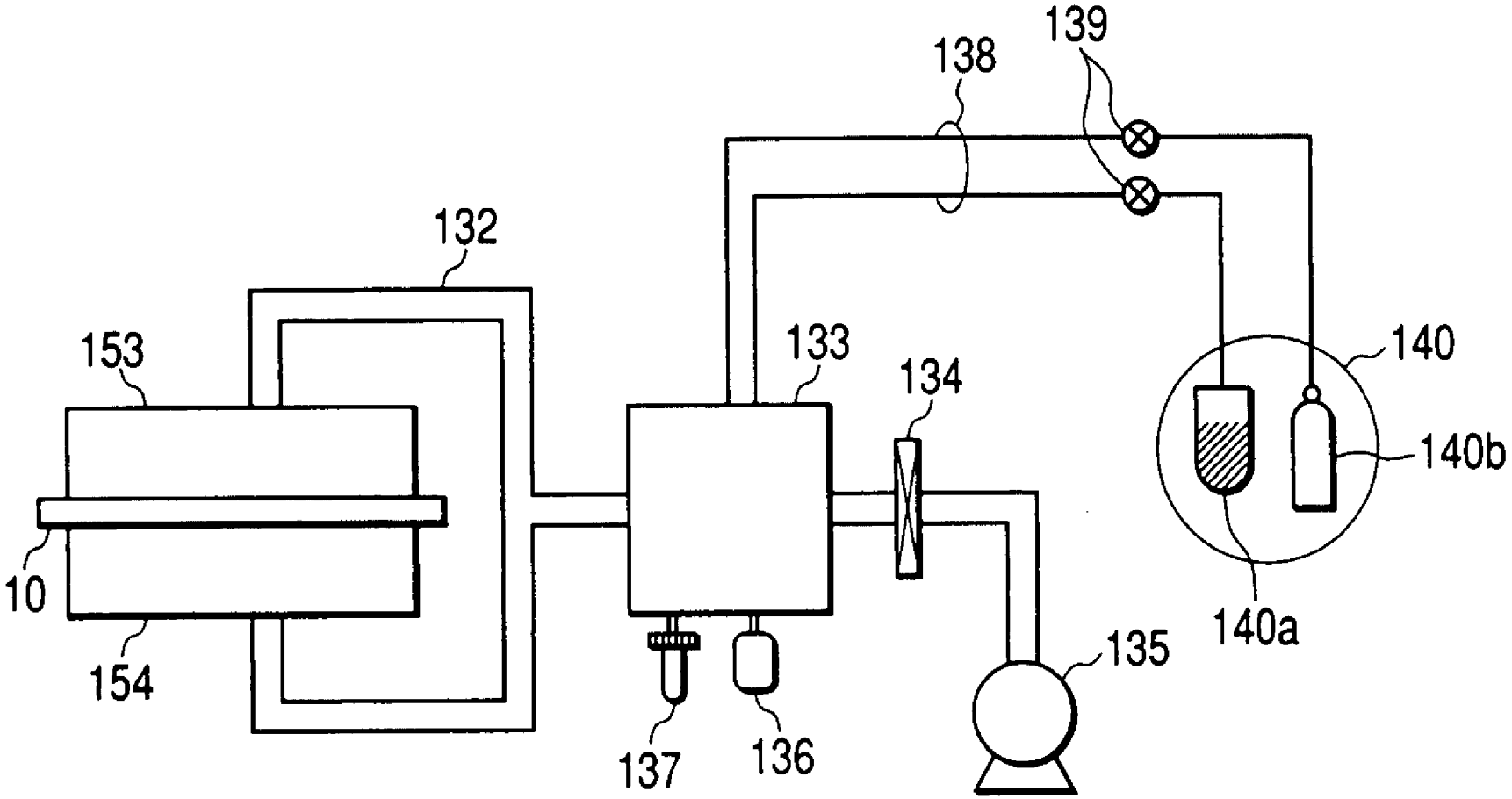
FIG. 11 is a schematic view showing a vacuum exhausting apparatus for performing processes of forming and activating the electron substrate using the present invention.
Figure 12:
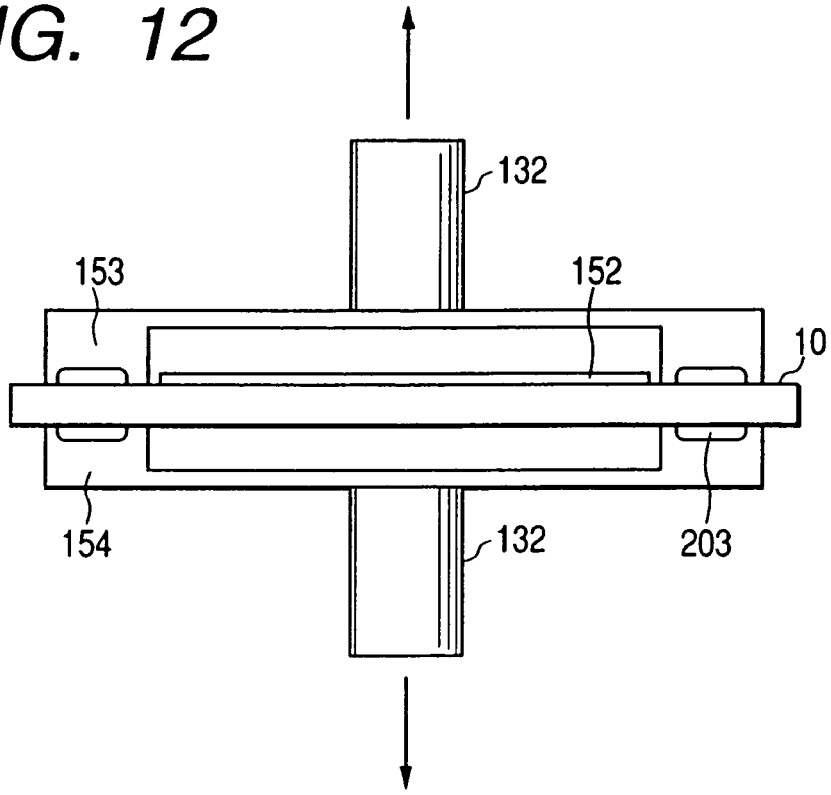
FIG. 12 is a cross-sectional view showing another example of the apparatus for manufacturing the electron source, having the auxiliary vacuum container, according to the present invention.

An electron source substrate of a matrix structure in the similar methods as described in the above embodiments are connected to the exhaust system shown in FIGS. 11 and 12, the forming process is performed by applying a voltage to each line after exhausting to the pressure of $1\times10^{-5}$ Pa, to thereby form a gap G shown in FIG. 25 to the electroconductive film 4. In FIGS. 11 and 12, reference numeral 132 denotes a gas exhausting port; 133, a vacuum chamber having a pressure gage 136 and a quadrupole mass spectrograph (Q-mass) 137; 134, a gate valve; 135, a vacuum pump for exhaustion; 138, a gas introduction line; 139, a gas introduction controlling device such as a solenoid valve or a mass flow controller; 140, an introduced substance source having an ampule 141*a* and a cylinder 141*b*; 152, an electron-emitting device; 153, a vacuum container; 154, an auxiliary vacuum container; and 203, an O-ring.

After completion of the forming process, acetone is introduced from the gas introduction line 138, a voltage is applied to each line as in the forming process to conduct the activation process, to form a carbon film 4 with a gap 5 as shown in FIGS. 24 and 25, thereby manufacturing an electron source substrate. Thereafter, when appropriate voltage was applied to an X direction electrode and a Y direction electrode, and the current value flowing in each element of the 640×480 pixels were measured, it was found that five elements were in a state where no current was flowing therethrough. Then, when a PdO electroconductive film was again formed in the defect portion to conduct the same forming process and the activation process as above, a defect portion regenerated, and it was possible to form the electron-emitting device of 640×480 without defects on the electron source substrate. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

Embodiment 15

Figure 13:
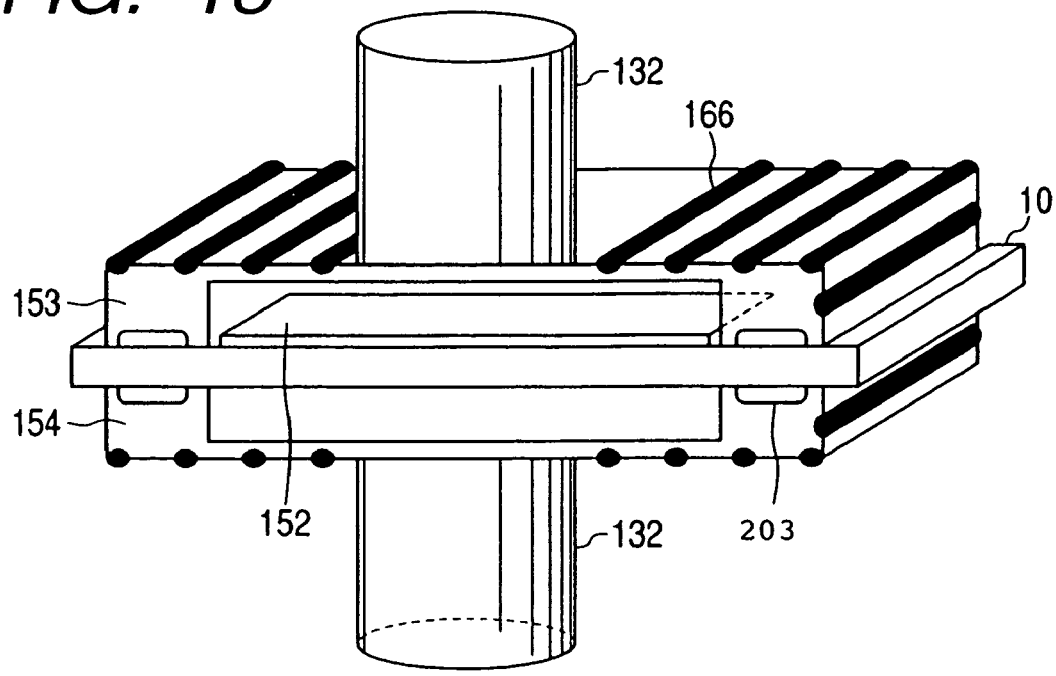
FIG. 13 is a perspective view showing another example of the apparatus for manufacturing the electron source, having the auxiliary vacuum container, according to the present invention.

FIG. 13 shows a schematic diagram of a manufacturing apparatus of an image displaying apparatus according to this embodiment. In this figure, reference numeral 10 denotes the electron source substrate; 152, an electron-emitting device; 153, a vacuum container; 154, a sub-vacuum container; 132, a gas exhausting path; 203, an O-ring; and 166, a baking heater. Similarly to Embodiment 14, the vacuum exhausting was performed to both surfaces of the electron source forming substrate with a plurality of surface conduction electron-emitting devices in matrix wiring to a pressure of $1\times10^{-7}$ Pa, and then, forming process and activation process were performed. In the activation process, energization was sequentially performed in a benzonitrile atmosphere of $1\times10^{-4}$ Pa. After the activation process, the vacuum chamber and the device forming substrate were baked at 250° C. by the baking heater for heating which was arranged in the vacuum chamber. Thereafter, using the electron source substrate 10 subjected to the above processes, the image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

In accordance with the manufacturing methods and manufacturing apparatuses shown in Embodiments 14 and 15, the following effects are provided.

(1) It is possible to detect defects of the electron source substrate before the outer frame for a product which contains the electron source substrate is fabricated. It is possible to always manufacture the outer frame for containing the electron source substrate with no defect by repairing the defect portions.

(2) It is possible to use a thin glass substrate as the electron source substrate by performing the vacuum exhaustion to both surfaces of the electron source substrate.

Embodiment 16

In this embodiment as well, the image displaying apparatus was manufactured provided with the electron source with a plurality of surface conduction electron-emitting devices shown in FIGS. 24 and 25 in matrix wiring as in FIG. 26.

Hereinafter, description will be made of this embodiment.

First, an ITO film was formed on the rear surface of a glass substrate into a thickness of 100 nm. The ITO film is used as an electrode for an electrostatic chuck when the electron source is manufactured. There is no limitation on the material for the ITO film provided that the resistivity is 109 Ωcm or less, and semiconductor, metal and the like may be used. In accordance with the manufacturing method, a plurality of row-directional wirings 7, a plurality of column-directional wirings 8, device electrodes 2 and 3 which are wired in matrix by the wirings, and a conductive film 4 made of PdO are formed on the surface of the glass substrate, to thereby manufacture an device forming substrate 10. Next, the subsequent process was performed using the manufacturing apparatus shown in FIG. 14.

Figure 14:
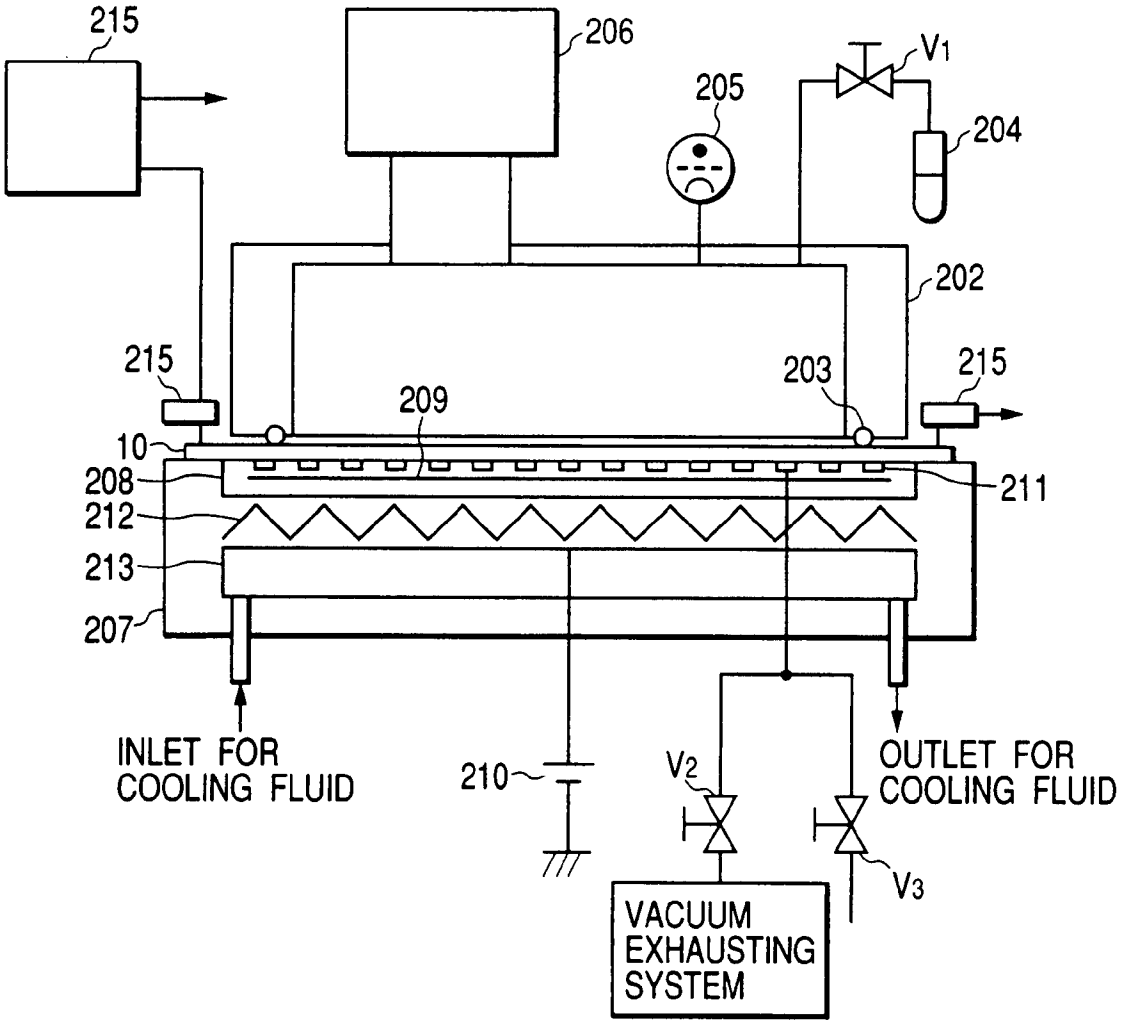
FIG. 14 is a cross-sectional view showing another example of the manufacturing apparatus according to the present invention.

In FIG. 14, reference numeral 202 denotes a vacuum vessel; 203, an O-ring; 204, benzonitrile as activation gas; 205, an ionization vacuum gage as a vacuum gage; 206, a vacuum exhausting system; 207, a supporting member; 208, an electrostatic chuck provided in the supporting member 207; 209, an electrode embedded in the electrostatic chuck 208; and 210, a high-voltage power source for applying high-voltage direct current to the electrode 209. Reference numeral 211 denotes a channel curved on the surface of the electrostatic chuck 208; 212, an electric heater; 213, a cooling unit; 214, a vacuum exhausting system; 215, a probe unit that can electrically contact a portion of wiring on the electron source substrate 10; 216, a pulse generator connected with the probe unit 215; and symbols V1 to V3 are valves.

The electron source substrate 10 was mounted on the supporting member 207, the valve V2 was opened, vacuum exhaustion was performed to the inside of the channel 211 to 100 Pa or less, and vacuum adsorption was performed to the electrostatic chuck 208. At this time, the rear surface, ITO film of the electron source substrate 10 was grounded at the same potential as the negative pole of the high-voltage power source 210 by a contact pin (not shown). Further, high-voltage direct current of 2 kV was supplied to the electrode 209 from the high-voltage power source 210 (grounded at the negative pole), and the electron source substrate 10 was electrostatically absorbed to the electrostatic chuck 208. Next, V2 was closed while V3 was opened, and He gas was introduced to the channel 211 to maintain the level of 500 Pa. He gas has an effect to improve heat conduction between the electron source substrate 10 and the electrostatic chuck 208. Note that He gas is most preferable, but $N_2$, Ar and the like may be used. There is no limit on the gas type provided that desired thermal conduction is obtained. Thereafter, the vacuum container 202 is mounted on the electron source substrate 10 through the O-ring 203 such that end portion of the wiring is on the outside of the vacuum container 202, to thereby form an airtight space in vacuum in the vacuum container 202. The space is vacuum-exhausted by the vacuum exhausting system 206 to the pressure of $1\times10^{-5}$ Pa or less. Cooling water at 15° C. was flown to the cooling unit 213. Further, electric power was supplied to the electric heater 212 by a power source having a temperature control function (not shown), to maintain the electron source substrate 10 at a constant temperature of 50° C.

Next, the probe unit 215 is made to have electrical contact with the end portion of the wiring on the electron source substrate 10, which is exposed on the outside of the vacuum container 202, and a triangular pulse with a base of 1 msec, a period of 10 msec, and a peak value of 10 V was applied for 120 sec by the pulse generator 216 connected to the probe unit 215, to thereby perform forming process. The heat generated by the electric current flowing in the forming process was effectively absorbed to the electrostatic chuck 208, and the electron source substrate 10 was maintained at a constant temperature of 50° C. Thus, good forming process was performed and the damage due to thermal stress was prevented.

A gap G in FIG. 25 was formed on the conductive film 4 according to the above forming process.

Next, the electric current flowing in the electric heater 212 was regulated, and the electron source substrate 10 was maintained at a constant temperature of 60° C. V1 was opened, and while the pressure is measured with the ionization vacuum gage 205, benzonitrile of $2\times10^{-4}$ Pa was introduced in the vacuum container 202. A triangular pulse with a base of 1 msec, a period of 10 msec, and a peak value of 15 V was applied for 60 minutes by the pulse generator 216 through the probe unit 215 to perform activation process. As in the forming process, the heat generated by the electric current flowing in the activation process was effectively absorbed to the electrostatic chuck 208, and the electron source substrate 10 was maintained at a constant temperature of 60° C. Thus, good activation process was performed and the damage due to thermal stress was prevented.

A carbon film 29 was formed with a gap 5 as shown in FIGS. 24 and 25 according to the above activation process.

Then, using an electron source substrate 10 subjected to the above processes, an image displaying apparatus shown in FIG. 23 is manufactured. First, the electron source substrate 10 and an outer frame 62 are fixed onto an RP 61, and this is made into an RP 2111 in FIGS. 21A to 21C. An FP 66 in which a phosphor 64 and a metal back 65 are made into an FP 2112 in FIGS. 21A to 21C. The RP 2111 and the FP 2112 are carried in the manufacturing apparatus shown in FIGS. 21A to 21C, and the image displaying apparatus shown in FIG. 23 was manufactured by using the manufacturing apparatus in FIGS. 21A to 21C, as described above.

In accordance with Embodiment 16, since the electrostatic chuck 208 and He gas were used in the forming process and activation process, good surface conduction electron-emitting devices having uniform characteristics were formed, and an image-forming panel having image performance with improved uniformity was manufacture. Further, the damage due to thermal stress could be prevented and the yield could be improved.

According to the present invention, it is possible to provide a manufacturing apparatus of an electron source which can be miniaturized and simple in operability.

According to the present invention, it is possible to provide a manufacturing apparatus of an electron source which is improved in manufacture speed and is suitable for mass production.

Also, according to the present invention, it is possible to provide a manufacturing apparatus of an electron source which can manufacture an electron source with an excellent electron-emitting characteristic.

Further, according to the present invention, it is possible to provide an image displaying apparatus with excellent image quality.

Furthermore, according to the present invention, when providing the electron emitting device or the plasma generating device in the BY direction in large quantity such as 100 million pixels or more, and manufacturing an image displaying apparatus on which the large quantity pixels are provided on a large screen with a diagonal size of 30 inches or more, manufacturing process time can be substantially reduced and, at the same time, a high vacuum degree of $10^{-6}$ Pa or more can be attained in a vacuum container forming the image displaying apparatus.

What is claimed is:

1. A method of manufacturing an image displaying apparatus, comprising the steps of:

a: disposing, on a support, a substrate on which an electrical conductor and a wiring connected to the conductor are formed; disposing, on the substrate, a container so that the container covers the electrical conductor on the substrate except for a part of the wiring; setting, into a desired atmosphere, a hermetic atmosphere formed between the container and the substrate; and applying a voltage to the conductor through the part of wiring, to form an electron-emitting device at a part of the conductor, and to form an electron source substrate;

b: disposing, within a vacuum atmosphere, one or both of the electron source substrate and a phosphor substrate on which phosphor emitting light by the electron-emitting device is arranged;

c: carrying under the vacuum atmosphere one or both of the electron source substrate and the phosphor substrate into the vacuum atmosphere in a gettering process chamber, and subjecting to a gettering process one or both of the substrates carried therein; and d: carrying under the vacuum atmosphere the electron source substrate and the phosphor substrate into a vacuum atmosphere in a seal-bonding process chamber, and subjecting to heat seal-bonding the substrates in an opposing state, wherein the gettering process chamber in step c is evacuated into a vacuum level higher than a vacuum level of the vacuum atmosphere in step b.

2. The method according to claim 1, wherein both the vacuum level of the gettering process chamber in step c and a vacuum level in the seal-bonding process chamber in step d are higher than a vacuum level in the vacuum atmosphere in step b.

3. The method according to claim 1, wherein step b further comprises a step of heating one or both of the electron source substrate and the phosphor substrate within the vacuum atmosphere.

4. The method according to claim 3, wherein a vacuum level of the vacuum atmosphere during the heating in step b is lower than the vacuum level in the gettering process chamber in step c.

5. The method according to claim 3, wherein a vacuum level of the vacuum atmosphere during the heating in step b is lower than the vacuum level in the gettering process chamber in step c and is lower than a vacuum level in the seal-bonding process chamber in step d.

6. The method according to claim 1, wherein steps b, c and d are performed in an in-line arrangement.

7. The method according to claim 1, wherein steps b, c and d are performed in a star arrangement.

* * * * *

UNITED STATES PATENT AND TRADEMARK OFFICE

CERTIFICATE OF CORRECTION

PATENT NO. : 7,326,097 B2
APPLICATION NO. : 10/913542
DATED : February 5, 2008
INVENTOR(S) : Ichiro Nomura et al.

It is certified that error appears in the above-identified patent and that said Letters Patent is hereby corrected as shown below:

ON THE TITLE PAGE ITEM (75) INVENTORS

"Ichiro Nomura, Kanagawa-ken (JP); Kohei Nakata, Tokyo (JP); Tetsuya Kaneko, Kanagawa-ken (JP); Toshihiko Miyazaki, Kanagawa-ken (JP); Yasue Sato, Tokyo (JP); Toshikazu Ohnishi, Kanagawa-ken (JP)"

should read

--Ichiro Nomura, Atsugi (JP); Kohei Nakata, Machida (JP); Tetsuya Kaneko, Yokohama (JP); Toshihiko Miyazaki, Isehara (JP); Yasue Sato, Machida (JP); Toshikazu Ohnishi, Sagamihara (JP)--.

ON THE TITLE PAGE ITEM (57) ABSTRACT

Line 6, "While, the" should read --The--.

COLUMN 2

Line 42, "sizes," should read --size,--; and
Line 44, "are" should read --have--.

COLUMN 10

Line 66, "cross" should read --cross- --.

COLUMN 11

Line 26, "(en" should read --(an--.

COLUMN 14

Line 4, "is" should read --are--; and
Line 18, "state" should read --state where--.

UNITED STATES PATENT AND TRADEMARK OFFICE

CERTIFICATE OF CORRECTION

PATENT NO. : 7,326,097 B2
APPLICATION NO. : 10/913542
DATED : February 5, 2008
INVENTOR(S) : Ichiro Nomura et al.

It is certified that error appears in the above-identified patent and that said Letters Patent is hereby corrected as shown below:

COLUMN 20

Line 24, “is” should read --are--; and
Line 26, “contacts” should read --contact--.

COLUMN 21

Line 25, “AS” should read --As--.

COLUMN 22

Line 47, “Width” should read --width--.

COLUMN 29

Line 9, “is” should read --are--.

COLUMN 30

Line 50, “are” should read --is--.

COLUMN 32

Line 40, “e” should read --a--.

COLUMN 33

Line 54, “are” should read --is--; and
Line 60, “that,” should read --that--.

COLUMN 34

Line 66, “collide” should read --to collide--.

COLUMN 35

Line 62, “were” should read --was--.

UNITED STATES PATENT AND TRADEMARK OFFICE

CERTIFICATE OF CORRECTION

PATENT NO. : 7,326,097 B2
APPLICATION NO. : 10/913542
DATED : February 5, 2008
INVENTOR(S) : Ichiro Nomura et al.

It is certified that error appears in the above-identified patent and that said Letters Patent is hereby corrected as shown below:

COLUMN 37

Line 7, “an” should read --a--.

COLUMN 38

Line 9, “is” should read --was--; and
Line 40, “manufacture.” should read --manufactured.--.

Signed and Sealed this

Sixteenth Day of September, 2008

JON W. DUDAS
*Director of the United States Patent and Trademark Office*